US009524727B2

(12) United States Patent
Grancharov et al.

(10) Patent No.: US 9,524,727 B2
(45) Date of Patent: Dec. 20, 2016

(54) METHOD AND ARRANGEMENT FOR SCALABLE LOW-COMPLEXITY CODING/DECODING

(71) Applicant: TELEFONAKTIEBOLAGET L M ERICSSON (PUBL), Stockholm (SE)

(72) Inventors: Volodya Grancharov, Solna (SE); Erik Norvell, Stockholm (SE); Sigurdur Sverrisson, Kungsängen (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 16 days.

(21) Appl. No.: 14/405,707

(22) PCT Filed: Nov. 13, 2012

(86) PCT No.: PCT/EP2012/072491

§ 371 (c)(1),
(2) Date: Dec. 4, 2014

(87) PCT Pub. No.: WO2013/185857

PCT Pub. Date: Dec. 19, 2013

(65) Prior Publication Data

US 2015/0149161 A1 May 28, 2015

Related U.S. Application Data

(60) Provisional application No. 61/659,605, filed on Jun. 14, 2012.

(51) Int. Cl.
*G10L 19/00* (2013.01)
*G10L 19/035* (2013.01)
(Continued)

(52) U.S. Cl.
CPC ..... *G10L 19/035* (2013.01); *G10L 19/002* (2013.01); *G10L 19/08* (2013.01)

(58) Field of Classification Search
CPC ..... G10L 19/00; G10L 19/12; G10L 19/24; H04N 19/124; H04N 19/149
(Continued)

(56) References Cited

U.S. PATENT DOCUMENTS 5,748,839 A * 5/1998 Serizawa ..... G06T 9/008 704/220
5,825,311 A * 10/1998 Kataoka ..... G06T 9/008 341/51

(Continued)

FOREIGN PATENT DOCUMENTS

GB 2 463 974 4/2010

OTHER PUBLICATIONS

JM Valin Mozilla Corporation K Vos Skype Technologies S A T Terriberry Mozilla Corporation: "Definition of the Opus Audio Codec; draft-ietf-codec-opus-13.txt", Definition of the Opus Audio Codec; Draft-IETF-Codec-Opus-13.txt, Internet Engineering Task Force, IETF May 16, 2012.

(Continued)

*Primary Examiner* — Daniel Abebe
(74) *Attorney, Agent, or Firm* — Baker Botts, LLP

(57) ABSTRACT

In a quantization method for quantizing a received excitation signal in a communication system performing the steps of re-shuffling S301 the elements of the received excitation signal to provide a re-shuffled excitation signal; coding S302 the re-shuffled excitation signal with a variable bit-rate algorithm to provide a coded excitation signal; and reassigning S303 codewords of the coded excitation signal if a number of used bits exceeds a predetermined fixed bit rate requirement to provide a quantized excitation signal.

25 Claims, 21 Drawing Sheets

(51) Int. Cl.
*G10L 19/002* (2013.01)
*G10L 19/08* (2013.01)

(58) Field of Classification Search
USPC ..... 704/223
See application file for complete search history.

(56) References Cited

U.S. PATENT DOCUMENTS 6,052,661 A * 4/2000 Yamaura ..... G10L 19/08 704/207
RE38,279 E * 10/2003 Kataoka ..... G06T 9/008 341/51
6,928,406 B1 * 8/2005 Ehara ..... G10L 19/10 704/200
7,698,132 B2 * 4/2010 Kandhadai ..... G10L 19/12 704/220
2004/0117176 A1 * 6/2004 Kandhadai ..... G10L 19/12 704/223
2005/0004793 A1 * 1/2005 Ojala ..... G10L 21/038 704/219
2009/0234653 A1 * 9/2009 Kawashima ..... G10L 19/005 704/263
2009/0248424 A1 * 10/2009 Koishida ..... G10L 19/24 704/503
2010/0046626 A1 * 2/2010 Tu ..... H04N 19/176 375/240.18
2014/0343953 A1 * 11/2014 Geiger ..... G10L 19/083 704/500

OTHER PUBLICATIONS

International Search Report for International application No. PCT/EP2012/072491 Mar. 8, 2013.
PCT International Preliminary Report on Patentability for International application No. PCT/EP2012/072491 Oct. 7, 2014.

* cited by examiner

METHOD AND ARRANGEMENT FOR SCALABLE LOW-COMPLEXITY CODING/DECODING

PRIORITY

This nonprovisional application is a U.S. National Stage Filing under 35 U.S.C. §371 of International Patent Application Serial No. PCT/EP2012/072491, filed Nov. 13, 2012 and entitled "Method and Arrangement for Scalable Low-Complexity Coding/Decoding" and U.S. Provisional Patent Application No. 61/659,605 filed Jun. 14, 2012.

TECHNICAL FIELD

The proposed technology relates to coding/decoding in general and specifically to improved coding and decoding of signals in a fixed-bitrate codec.

BACKGROUND

Typically, speech/audio codecs process low- and high-frequency components of an audio signal with different compression schemes. Most of the available bit-budget is consumed by the LB (Low frequency Band) coder (due to the higher sensitivity of human auditory system at these frequencies). In addition to that, most of the available computational complexity is also consumed by the LB codec, e.g., analysis-by-synthesis ACELP (Algebraic Code Excited Linear Prediction). This leaves severe requirements on the complexity available to the HB (High frequency Band) codec.

Due to the mentioned above constraints the HB part of the signal is typically reconstructed by a parametric BWE (Band Width Extension) algorithm. This solution handles the problem of the constrained bit-budget and limited complexity, but it completely lacks scalability, which means that the quality quickly saturates and does not follow the bit-rate increase.

Variable bit-rate schemes such as entropy coding schemes present an efficient way to encode sources at a low average bit-rate. However, many applications rely on a fixed bit-rate for the encoded signal, such as e.g. mobile communication channels. The number of consumed bits for a segment of a given input signal is not known before the entropy coding has been completed. One common solution is to run several iterations of the entropy coder until a good compression ratio within the fixed bit budget has been reached.

Consequently, there is a need for methods and arrangements to enable low-complexity and scalable coding of the high band part of audio signals and enables utilizing a variable bit-rate quantization scheme within a fixed bitrate framework.

The solution of running multiple iterations for the entropy coder is a computationally complex solution, which may not fit in the context of real-time communication on a device with limited processing power.

SUMMARY

A general object of the proposed technology is improved coding and decoding of audio signals.

A first aspect of the embodiments relates to a method for quantizing a received excitation signal in a communication system. The method includes the steps of re-shuffling the elements of an excitation signal to provide a re-shuffled excitation signal, coding the re-shuffled excitation signal, and reassigning codewords of the coded excitation signal if a number of used bits exceeds a predetermined fixed bit rate requirement to provide a quantized excitation signal.

A second aspect of the embodiments relates to a method for reconstructing an excitation signal in a communication system. The method includes the steps of entropy decoding a received quantized excitation signal, and SQ decoding the entropy decoded excitation signal to provide a reconstructed excitation signal.

A third aspect of the embodiments relates to an encoding method in a communication system. The method includes the steps of extracting a representation of a spectral envelope of an audio signal, and providing and quantizing an excitation signal based on at least the representation and the audio signal, the quantization being performed according to the previously described quantizer method. Further, the method includes the steps of providing and quantizing a gain for the audio signal based on at least the excitation signal, the provided representation and the audio signal, and finally transmitting quantization indices for at least the quantized gain and the quantized excitation signal to a decoder unit.

A fourth aspect of the embodiments relates to a decoding method in a communication system. The method includes the steps of generating a reconstructed excitation signal for an audio signal based on received quantization indices for an excitation signal. The quantization indices for the excitation signal have been provided according to the above described quantizer method. Further the method includes the steps of generating and spectrally shaping a reconstructed representation of the spectral envelope of the audio signal based on at least the generated reconstructed signal and received quantized representation of a spectral envelope of the audio signal, to provide a synthesized audio signal. Finally, the method includes the step of up-scaling the thus synthesized audio signal based on received quantization indices for a gain, to provide a decoded audio signal.

A fifth aspect of the embodiments relates to a quantizer unit for quantizing a received excitation signal in a communication system. The quantizer unit includes a re-shuffling unit configured for re-shuffling the elements of an excitation signal to provide a re-shuffled excitation signal, a coding unit configured for coding the re-shuffled excitation signal to provide a coded excitation signal, and a reassigning unit configured for reassigning codewords of the coded excitation signal.

A sixth aspect of the embodiments relates to a de-quantizer unit for reconstructing an excitation signal in a communication system. The de-quantizer unit includes an entropy-decoding unit configured for entropy decoding a received quantized excitation signal, and an SQ decoding unit configured for SQ decoding the entropy decoded excitation signal. Further, the de-quantizer unit includes an inverse re-shuffling unit configured for inversely re-shuffling the elements of the reconstructed excitation signal.

A seventh aspect of the embodiments relates to an encoder unit. The encoder unit includes a quantizer unit as described above and further an extracting unit configured for extracting a representation of a spectral envelope of an audio signal, and the quantizer unit is configured for providing and quantizing an excitation signal based on at least the representation and the audio signal. Further, the encoder includes a gain unit configured for providing and quantizing a gain based on at least the excitation signal, the provided representation, and the audio signal, and a transmitting unit configured for transmitting quantization indices for at least the quantized gain and the quantized excitation signal to a decoder unit.

An eighth aspect of the embodiments relates to a decoder unit. The decoder unit includes a de-quantizer unit for generating a reconstructed excitation signal based on received quantization indices for an excitation signal for an audio signal, and a synthesizer unit configured for generating and spectrally shaping a reconstructed representation of the spectral envelope of the audio signal based at least on the generated reconstructed excitation signal and a received quantizer representation of the spectral envelope to provide a synthesized audio signal. Finally, the decoder unit includes a scaling unit configured for up-scaling the synthesized audio signal based on received quantization indices for a gain to provide a decoded audio signal.

The proposed technology also involves a user equipment and/or a base station terminal including at least one such quantizer unit, de-quantizer unit, encoder unit or decoder unit.

An advantage of the proposed technology is scalable low-complexity coding of high-band audio signals.

BRIEF DESCRIPTION OF THE DRAWINGS

The embodiments of the proposed technology, together with further objects and advantages thereof, may best be understood by referring to the following description taken together with the accompanying drawings, in which.

ABBREVIATIONS

ACELP: Algebraic Code Excited Linear Prediction
AR: Auto Regressive
BWE: Bandwidth Extension
DFT: Discrete Fourier Transform
HB: High frequency Band
LB: Low frequency Band
MDCT: Modified Discrete Cosine Transform
PCM: Pulse Code Modulation
SQ: Scalar Quantizer
VQ: Vector Quantizer

DETAILED DESCRIPTION

The proposed technology is in the area of audio coding, but is also applicable to other types of signals. It describes technology for a low complex adaptation of a variable bit-rate coding scheme to be used in a fixed rate audio codec. It further describes embodiments of methods and arrangements for coding and decoding the HB (High frequency Band) part of an audio signal utilizing a variable bit-rate coding scheme within a fixed-bitrate codec. Although the embodiments mainly relate to coding and decoding of high frequency band audio signals, it is equally applicable to any signal, e.g. audio or image, and any frequency range where a fixed bitrate is applied.

Throughout this description, the terms excitation, excitation signal, residual vector, and residual are used in an exchangeable manner.

The embodiments provide a lightweight and scalable structure for variable bit-rate coding in a fixed bit-rate codec, and is particularly suitable for, but not limited to, HB audio coding and frequency domain coding schemes. One key aspect of the embodiments includes jointly designed lossy and lossless compression modules, which together with codeword reassignment logic operate at a fixed-bitrate. In this way, the system has the complexity and scalability advantage of SQ (Scalar Quantization), at relatively low-bitrate, where SQ technology is typically not applicable.

Known methods of utilizing variable bit rate schemes within a fixed bit rate scheme include performing a quantization step multiple times until a predetermined fixed bitrate is achieved.

One main concept of the invention is the combination of an entropy coding scheme with a low complex adaptation to fixed bit-rate operation. Here it is first presented in the context of a time-domain audio codec and later in the context of a frequency-domain audio codec.

Figure 1:
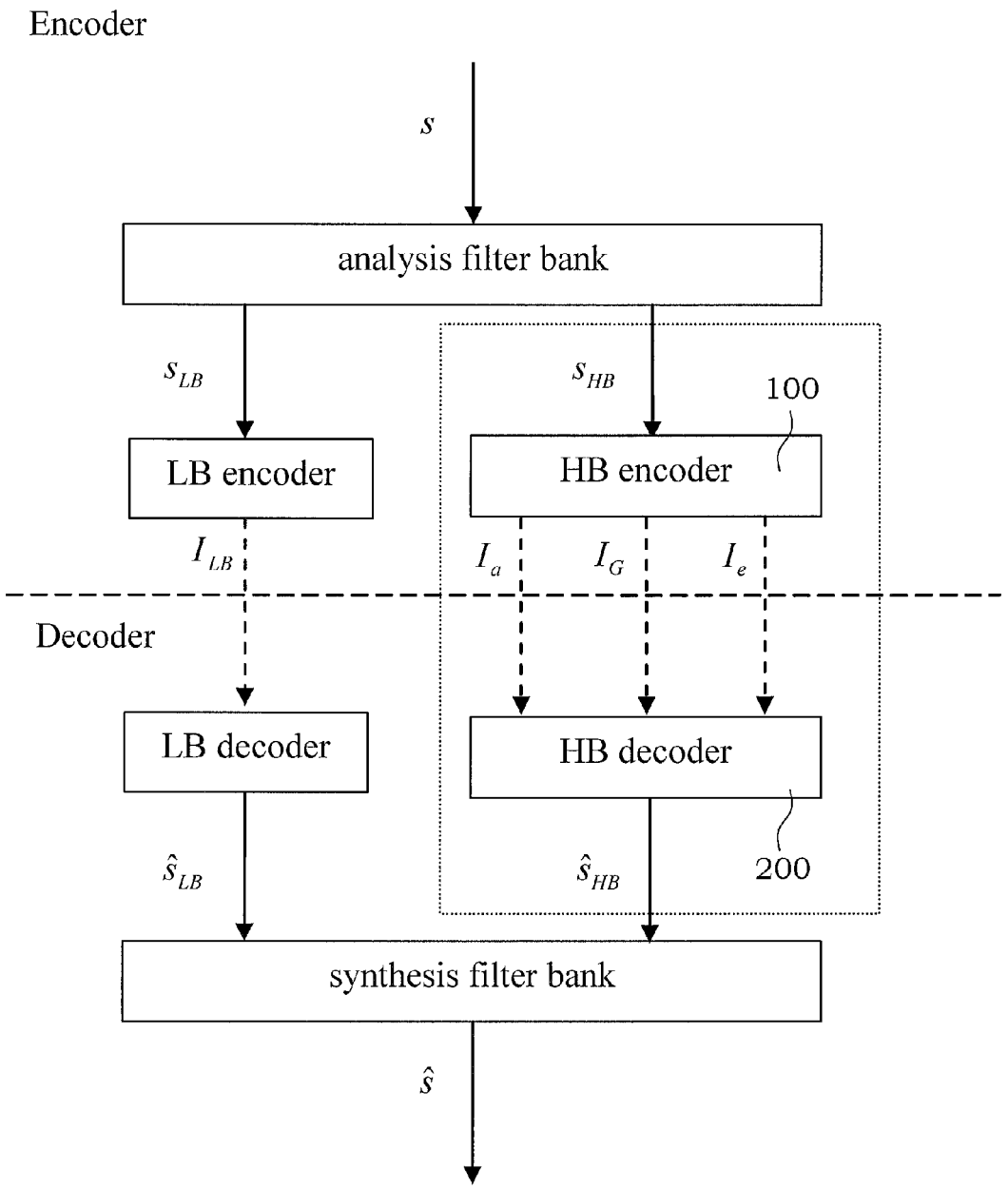
FIG. 1 is a flow chart of an embodiment of audio coding in the time domain.

A high-level block-diagram of an embodiment of an audio codec in the time domain is presented in FIG. 1; both the encoder and the decoder are illustrated. An input signal s is sampled at 32 kHz, and has an audio bandwidth of 16 kHz. An analysis filter bank outputs two signals sampled at 16 kHz, where $s_{LB}$ represents 0-8 kHz of the original audio bandwidth, and $s_{HB}$ represents 8-16 kHz of the original audio bandwidth. This embodiment describes an algorithm for processing the high frequency band part $s_{HB}$ of a received signal (as indicated by the dotted box in FIG. 1), while the LB is assumed to be ACELP coded (or some other legacy codec). In this scheme, the LB encoder and decoder may operate independently of or in cooperation with the HB encoder and decoder. The LB encoding may be done using any suitable scheme and produces a set of indices $I_{LB}$ which may be used by the LB decoder to form the corresponding LB synthesis $\hat{s}_{LB}$. Further, the embodiment is not limited to a particular frequency interval, but can be used for any frequency interval. However, for illustration purposes the embodiments mainly describes the methods and arrangements with relation to a high frequency band signal.

Real-time audio coding is typically done in frames (blocks) that are compressed in an encoder and transmitted as a bitstream to a decoder over a network. The decoder reconstructs these blocks from the received bitstream and generates an output audio stream. The algorithm in the embodiments operates in the same way. A HB audio signal is typically processed in 20 ms blocks. At 16 kHz sampling frequency, this corresponds to 320 samples processed at a given time instant. However, the same method can be applied to any size blocks and for any sampling frequency.

Figure 2:
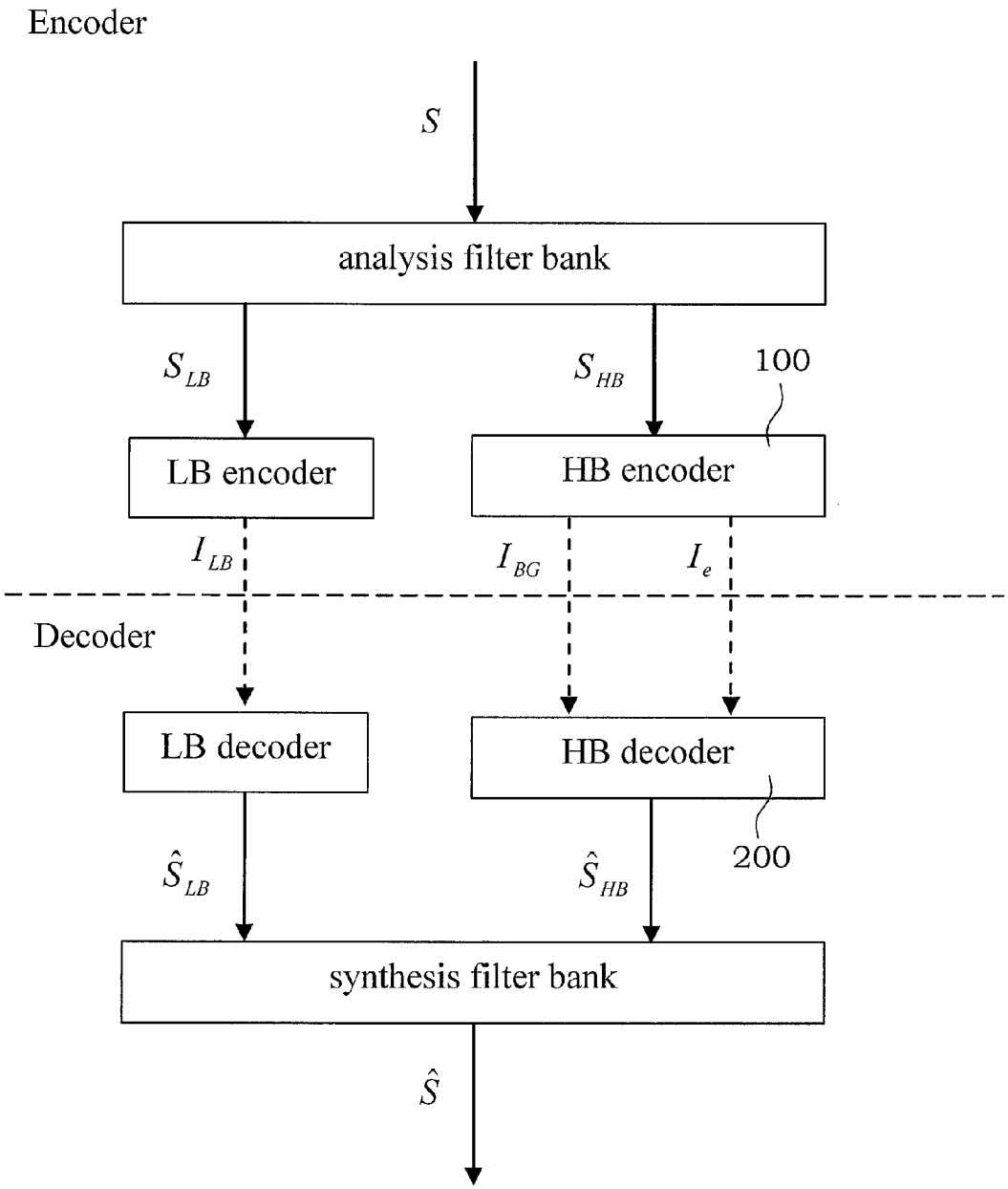
FIG. 2 is a flow chart of a further embodiment of audio coding in the frequency domain.

Although the majority of the present disclosure explicitly deals with quantization in a time domain, it is equally applicable within the frequency domain, in particular within a MDCT context. A corresponding high-level block-diagram of coding/decoding in the frequency domain is illustrated in FIG. 2. Let capital letters denote the frequency-domain representation of the signals, e.g. S(k) denotes the set of transform coefficients obtained by frequency transform of the waveform s(n). The main difference between FIG. 1 and FIG. 2 is that instead of quantization indices for the global gain $I_G$, AR coefficients $I_a$, the frequency-domain encoder transmits quantization indices for a set of band gains $I_{BG}$. These band gains BG represent the frequency or spectral envelope, which in the time-domain codec is modeled by AR coefficients and one global gain. The band-gains are calculated by grouping 8, 16, 32, etc transform coefficients and calculating the root-mean-squared energy for these groups (bands).

Some of the benefits of the frequency-domain approach are. A) down- and up-sampling can be avoided (low/high frequency components of the coded vector can be directly selected), and B) easier to select regions with lower perceptual importance, as an example, the effects of masking of weak tones in the presence of stronger tones requires frequency-domain processing.

In order to provide the necessary quantization indices for the excitation signal, for either the time domain scheme or the frequency domain scheme, the inventors have developed a novel quantization method and arrangement, which enables utilizing a variable bit-rate algorithm in a fixed bit-rate scheme. The same quantization method can be utilized regardless if the quantization takes place in a frequency domain based encoder/decoder or a time domain based encoder/decoder.

According to an aspect of the current disclosure, a novel quantizer arrangement and method for quantizing an excitation signal for a signal (audio or other) to be subsequently encoded will be described with reference to FIG. 3 and FIG. 4.

Figure 3:
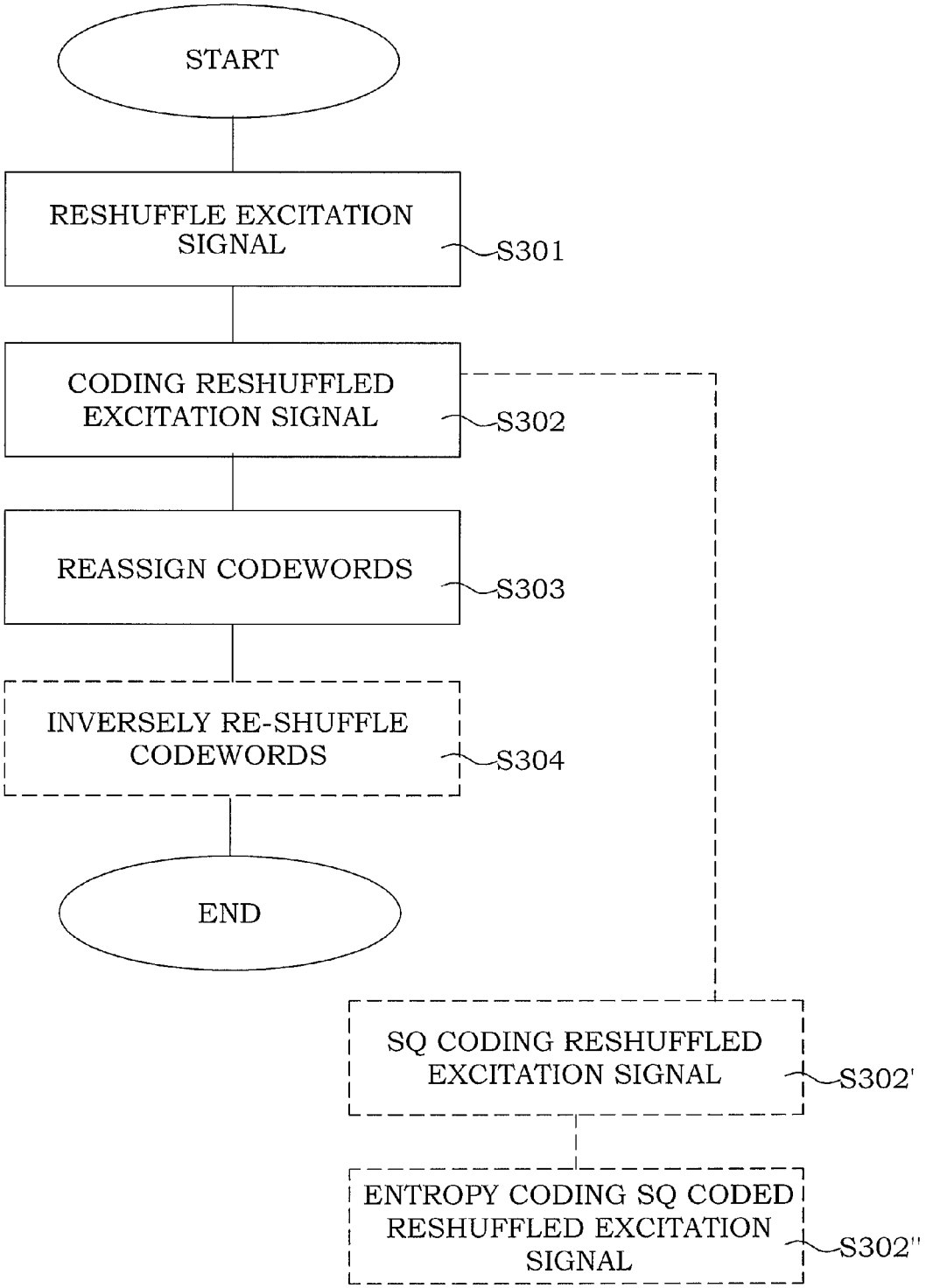
FIG. 3 is a flow chart of an embodiment of a method in a quantizer.

With reference to FIG. 3, an embodiment of a quantizer unit 300 for use in an encoder and a method thereof will be described. The quantizer unit 300 performs quantization of an excitation signal and reassigns codewords of the quantized coded excitation signal in order to reduce the bit rate consumed by the excitation.

The quantizer method will be denoted $Q_e$ in the following description, and is given in more detail in FIG. 4. Initially, in step S301, the elements of the excitation vector of an e.g. audio signal are re-shuffled, e.g. in order to prevent producing errors localized in time. Subsequently, the re-shuffled excitation vector e.g. re-shuffled excitation signal is coded S302 with a variable bit-rate algorithm to provide a coded excitation signal. According to a particular embodiment the excitation vector is PCM coded with a uniform SQ in step S302', for example using a 5-level mid-tread (the same number positive and negative levels) SQ, and subsequently entropy encoded in step S302".

The re-shuffling step S301 and the coding step S302 can be performed in any order without affecting the end-result. Consequently, the coding step S302 can be applied to the received excitation signal and the elements of the coded excitation can be subsequently re-shuffled S301.

Finally, the codewords of the coded excitation signal are reassigned in step S303 if the number of used bits for the coded signal exceeds a predetermined fixed bit rate requirement, the reason for this is further explained below.

According to a further embodiment, the quantizer unit and method optionally includes a unit for performing a step S304 of inversely re-shuffling the elements of the codeword reassignment in order to re-establish the original order of the elements of the excitation signal.

Since SQ schemes are generally not efficient at low bit-rates, entropy coding such as Huffman coding or similar is used for more efficient use of the available bits. The concept of the Huffman codes is that shorter codewords are assigned to symbols that occur more frequently; see Table 1 below, which presents the Huffman code for a 5 level quantizer. Each reconstruction level has attached a codeword (shorter for more probable amplitudes, which correspond also to lower amplitudes).

TABLE 1

| amplitude | codeword |
|---|---|
| +2 | 0010 |
| +1 | 01 |
| 0 | 1 |
| −1 | 000 |
| −2 | 0011 |

Since Huffman coding is a variable bit-rate algorithm, a special codeword reassignment algorithm according to the present embodiments is used to fit the HB coding into a fixed-bitrate requirement. The "Codeword reassignment" module in FIG. 4 is activated when the actually used number of bits B, after the entropy or Huffman coding, exceeds an allowed limit $B^{TOT}$ For simplicity reasons, assume that elements of the excitation vector are mapped to one of the five levels represented in Table 1. Based on the assigned amplitude level, the elements are clustered into three groups; Group 0 (all elements mapped to zero level amplitude), Group 1 (all+/−1 amplitude level), and Group 2 (all+/−2). A general concept of the algorithm of the present embodiments is to iteratively move elements from Group 1 to Group 0 to reassign elements from a longer codeword to a shorter codeword. With each element moved the total number of consumed bits decrease, since elements in Group 0 have the shortest codeword, see Table 1. The procedure continues as long as the total amount of bits consumed is larger than the bit-budget. When the amount of consumed bits is equal to or less than the set bit-budget, the procedure terminates. If Group 1 contains no more elements and the bitrate target is still not met, elements from Group 2 are transferred one by one to Group 0. This procedure guarantees that the bitrate target will be met, as far as it is larger than 1 bit/element. The total number of groups depends on the number of levels in the SQ such that each amplitude level or a group of similar amplitude levels corresponds to one group.

Although the above description mainly deals with Huffman coding, it is equally possible to utilize any other codec, which has a variable codeword length depending on amplitude probability, preferably a codec where a shorter codeword is assigned to higher probability amplitude. It is further possible to include a step of providing a plurality of Huffman tables (or other codes) and performing a selection of an optimal or preferred table. Another possibility is to use one or more codes (Huffman or other) out of a plurality of provided codes. The main criterion for the code is that there is a correlation between amplitude probability and codeword length.

The motivation behind this procedure is that the lowest amplitudes are set to zero first, which leads to lower error in the reconstructed signal. Since the elements of the excitation vector are re-shuffled or randomly selected, extracting a sequence of elements from Group 1 and zeroing their amplitudes does not produce error localized in time (the error is spread over the entire vector). Instead of performing an actual re-shuffling of the excitation vector and then extracting elements from Group 1 in a sequence, it is possible to randomize directly the extraction step The excitation quantization consumes most of the available bits. It easily scales with increasing bitrate by increasing the number of reconstruction levels of the SQ.

In a corresponding manner the quantized excitation signal needs to be reconstructed in a receiving unit e.g. decoder or de-quantizer unit in a decoder, in order to enable reconstructing the original audio signal.

Accordingly, with reference to FIG. 5, an embodiment of a de-quantization or reconstructing method for reconstructing excitation signals will be described. Initially, a received quantized excitation signal is entropy decoded in step S401. Subsequently, the entropy decoded excitation signal is SQ decoded in step S402 to provide a reconstructed excitation signal. Further, the elements of the reconstructed excitation signal are inversely re-shuffled in step S403, if the elements of the reconstructed excitation signal have been previously re-shuffled in a quantizer unit or encoder.

Figure 6:
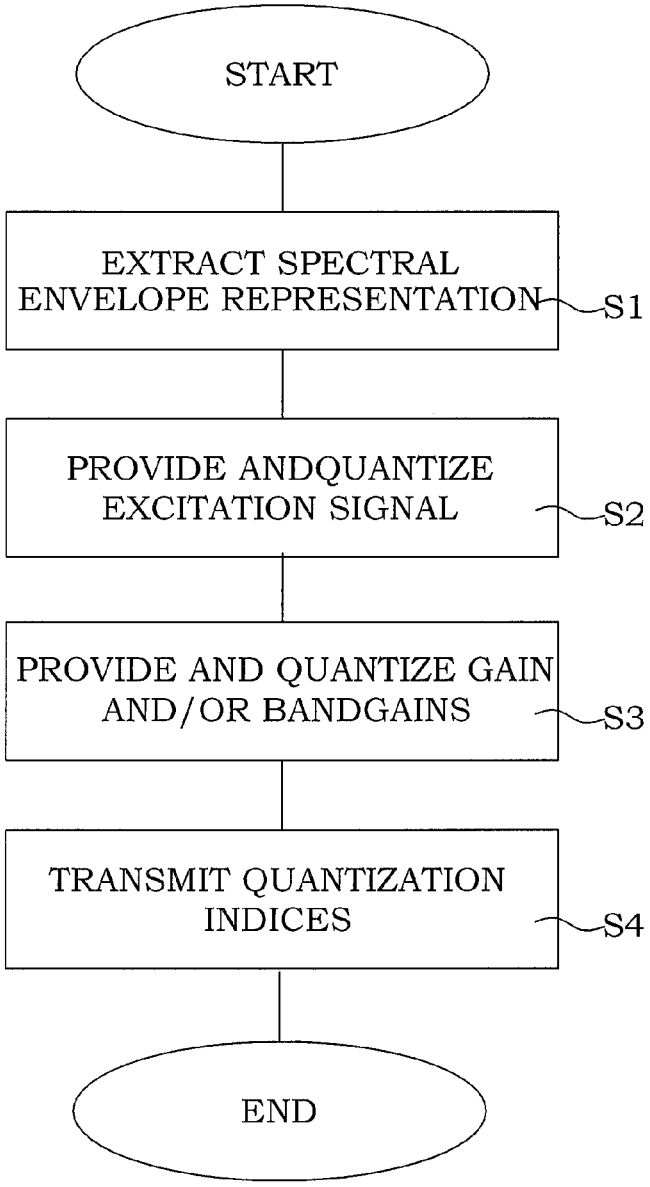
FIG. 6 is a flow chart of an embodiment of a method in an encoder.

With reference to FIG. 6, an embodiment of a method in an encoder unit in a communication network will be described.

Initially, a representation of a spectral envelope of an audio signal is extracted in step S1. For a time-domain application the representation of the spectral envelope can comprise the auto regression coefficients, and for a frequency domain application the representation of the spectral envelope can comprise a set of band gains for the audio signal. Subsequently, in step S2, an excitation signal for the audio signal is provided and quantized. The quantization is performed according to the previously described embodiments of the quantization method. Further, in step S3 a gain is provided and quantized for the audio signal based on at least the extracted excitation signal, the provided representation of the spectral envelope and the audio signal itself. Finally, in step S4, quantization indices for at least the quantized gain and the quantized excitation signal are transmitted to or provided at a decoder unit.

Figure 7:
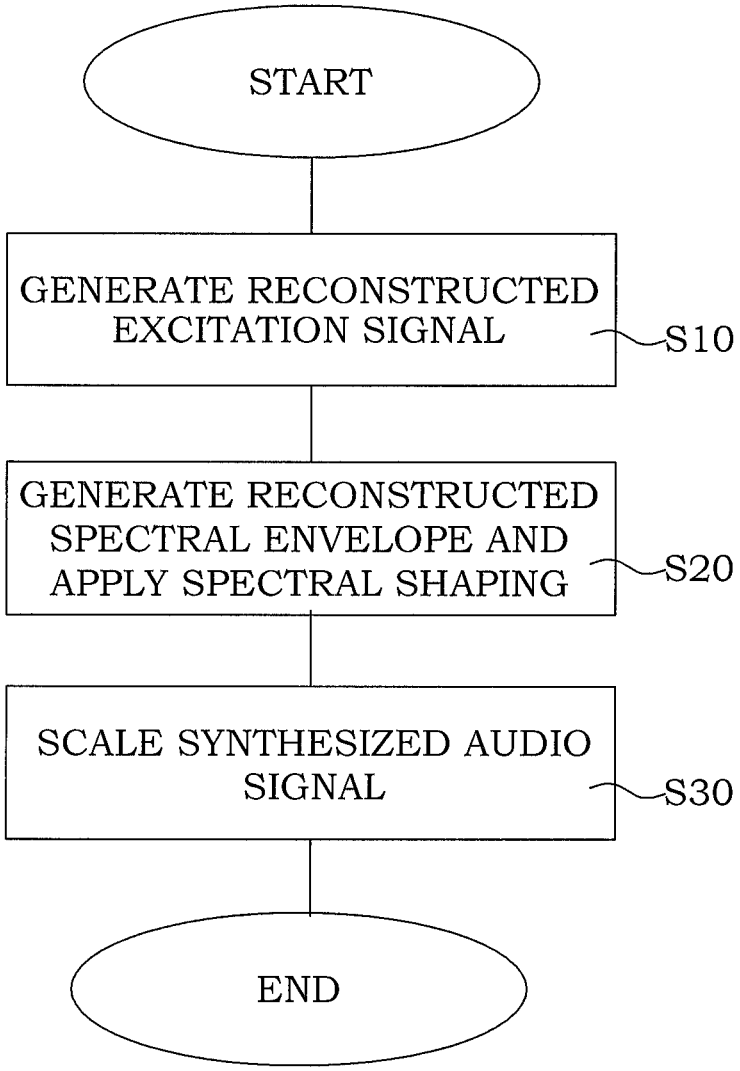
FIG. 7 is a flow chart of an embodiment of a method in a decoder.

With reference to FIG. 7, a corresponding decoding method includes the steps of reconstructing S10 a received excitation signal of an audio signal, which excitation signal has been quantized according to the quantizer method previously described. Subsequently, the spectral envelope of the audio signal is reconstructed and spectral shaping is applied in step S20. Finally, in step S30, the gain of the audio signal is reconstructed and gain up-scaling is applied to finally synthesize the audio signal.

Figure 8:
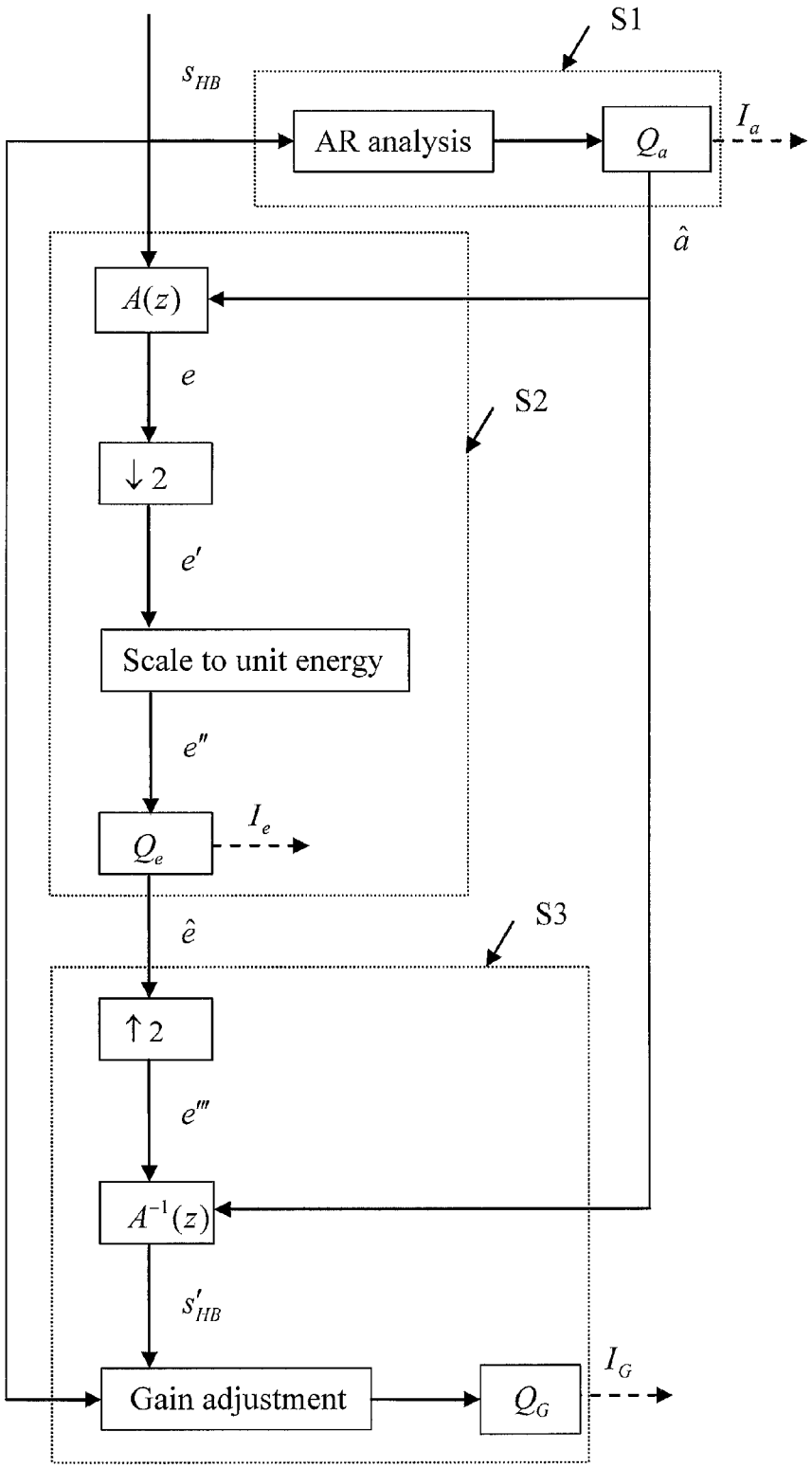
FIG. 8 is a flow chart of an embodiment of a time domain based method in an encoder.

With reference to FIG. 8, embodiments of an encoding method in the time domain will be described. Initially, a signal e.g. high frequency band part of an audio signal, is received and a set of auto regression (AR) coefficients, comprising the representation of the spectral envelope, are extracted and quantized, as indicated by the dotted box, in step S1 and their respective quantization indices $I_a$ are subsequently transmitted to a decoder in the network. Then, an excitation signal is provided and quantized, as indicated by the dotted box, in step S2 based on at least the quantized AR coefficients $\hat{a}$, and the received signal. The quantization indices $I_e$ for the excitation are also transmitted to the decoder. Finally, a gain G is provided and quantized, as indicated by the dotted box, in step S3 based on at least the excitation signal, the quantized AR coefficients, and the received audio signal. The quantization indices $I_G$ for the gain are also transmitted to the decoder.

Below follows, a more detailed description of the various steps and arrangements described above.

An embodiment of the HB encoder operations is illustrated in FIG. 8. Initially AR analysis is performed on the HB signal to extract set a of AR coefficients a. The coefficients a are quantized (SQ or VQ (Vector Quantized) in the range of 20 bits) into quantized AR coefficients $\hat{a}$ and as the corresponding quantizer indices $I_a$ are sent to the decoder. The subsequent encoder operations are all performed with these quantized AR coefficients $\hat{a}$, thereby matching the filter which will be used in the decoder. An excitation signal or residual e(n) is generated by passing a waveform (e.g. the high band signal) $s_{HB}(n)$ through a whitening filter based on the quantized AR coefficients $\hat{a}$, as shown in Equation 1 below $$e(n)=A(z)s_{HB}(n), \tag{1}$$

where $A(z)=1+\hat{a}_1z^{-1}+\hat{a}_2z^{-2}+\ldots+\hat{a}_Mz^{-M}$, is the AR model of order M=10.

The excitation signal or residual is down sampled to 8 kHz, which corresponds to vectors with length N=160 samples. This down sampled excitation signal contains the frequency components 8-12 kHz of the original bandwidth of audio input s. The motivation behind this operation is to focus available bits, and accurately code perceptually more important signal components (8-12 kHz). Spectral regions above 12 kHz are typically less audible, and can easily be reconstructed without the cost of additional bits. However, it is equally applicable to perform any other degree of down sampling of parts of or the entire high frequency band spectrum of the audio input signal s.

It should be noted that this down sampling is optional and may be unnecessary if the available bit budget permits coding the entire frequency range. If, on the other hand, the bit budget is even more restricted a down sampling to an even narrower band may be desired, e.g. representing the 8-10 kHz band, or some other frequency band.

Prior to quantization, the optionally down sampled excitation signal or residual vector e' is normalized to unit energy, according to Equation 2 below. This scaling facilities shape quantization operation (i.e. the quantizers do not have to capture global energy variations in the signal).

$$e''(n) = \frac{e'(n)}{\sqrt{\frac{1}{N}\sum_{n=0}^{N-1} e'^2(n)}} \quad n = 0 \ldots N-1, \tag{2}$$

The actual residual quantization is performed in $Q_e$ block in FIG. 8, and was described previously with reference to FIG. 3. A corresponding quantizer unit 300 will also be described later on.

In order to calculate and transmit the appropriate energy level of the HB signal, the encoder performs the steps of synthesizing the waveform (in the same manner as in the decoder). First the residual ê with bandwidth 8-16 kHz is reconstructed e''' from the coded one (8-12 kHz residual) through up sampling with spectrum folding. Then the waveform is synthesized by running reconstructed excitation through all-pole autoregressive filter to form the synthesized high frequency band signal $s'_{HB}$. The energy of the synthesized waveform $s'_{HB}$ is adjusted to the energy of the target waveform $s_{HB}$. The corresponding gain G, as defined in Equation 3, can be efficiently quantized with a 6 bit SQ in logarithmic domain.

$$G = \frac{\sqrt{\frac{1}{N}\sum_{n=0}^{N-1} s_{HB}^2(n)}}{\sqrt{\frac{1}{N}\sum_{n=0}^{N-1} s'^2_{HB}(n)}}, \tag{3}$$

In summary, on a frame-by-frame basis, embodiments of the encoder in the time domain quantizes and transmits quantization indices for a set of AR coefficients $I_a$, one global gain $I_G$, and excitation signal $I_e$ for a received signal.

Figure 9:
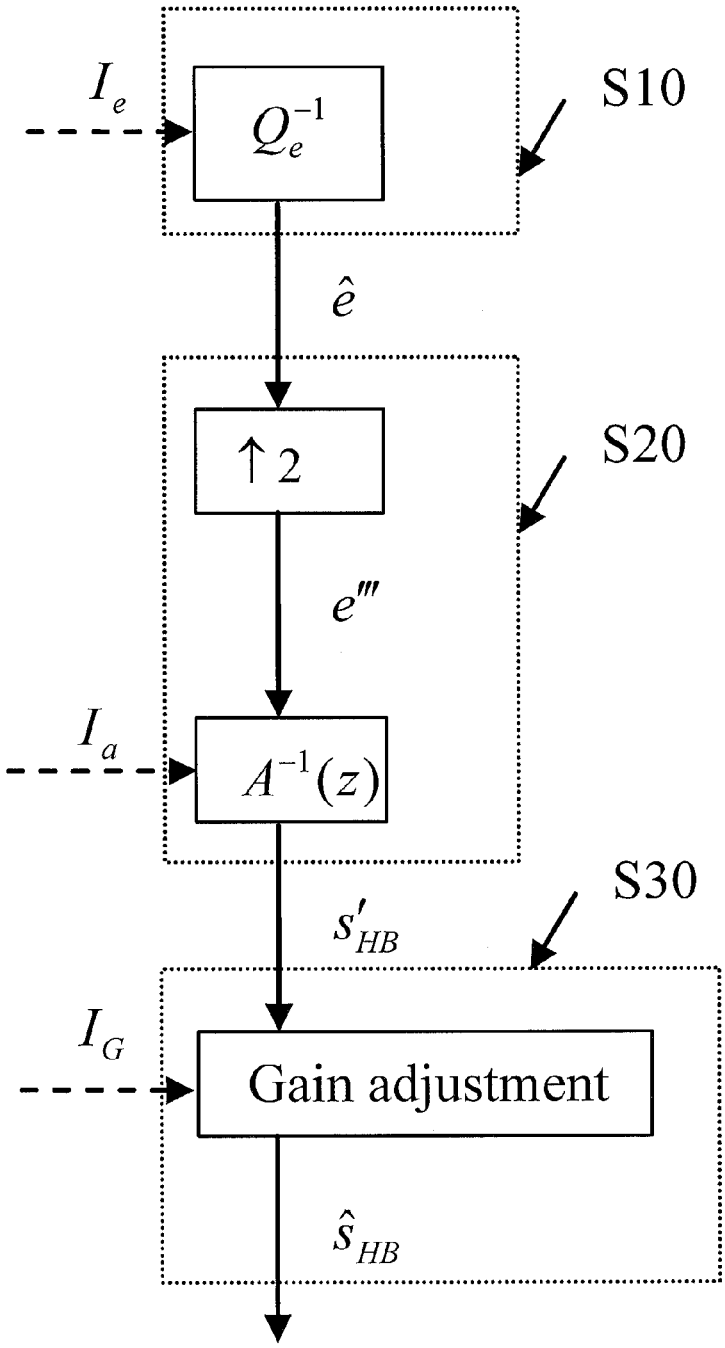
FIG. 9 is a flow chart of an embodiment of a time domain based method in a decoder.

With reference to FIG. 9, embodiments of a decoder unit 200 and methods therein will be described below. A particular embodiment in the time domain of the method described with reference to FIG. 7, also includes the steps of generating S10 a reconstructed signal ê based on received quantization indices $I_e$ for an excitation signal of an audio signal, and generating and spectrally shaping S20 a reconstructed representation of a spectral envelope of the audio signal based on the generated reconstructed signal and on received quantized auto regression coefficients $I_a$ as the representation of the spectral envelope to provide a synthesized audio signal $s'_{HB}$. Finally, the method includes the step of scaling S30 the synthesized audio signal $s'_{HB}$ based on a received quantization indices $I_G$ for a gain to provide the decoded audio signal $\hat{s}_{HB}$.

A decoder 200 according to the present disclosure reconstructs the HB signal by extracting from the bitstream, received from the encoder unit 100, quantization indices for the global gain $I_G$, AR coefficients $I_a$, and excitation vector $I_e$.

Figure 4:
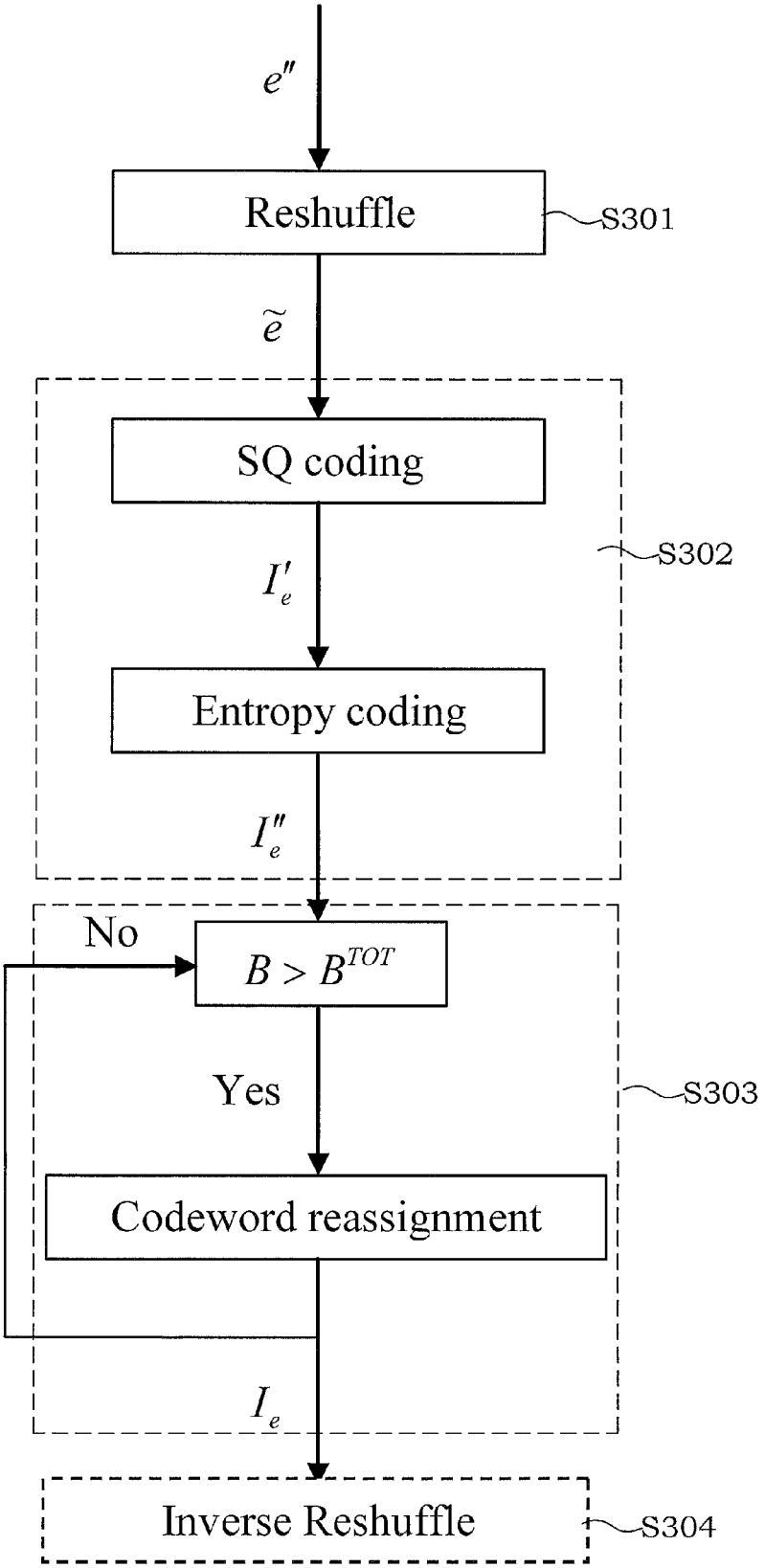
FIG. 4 is a flow chart of a further embodiment of a method in a quantizer.
Figure 5:
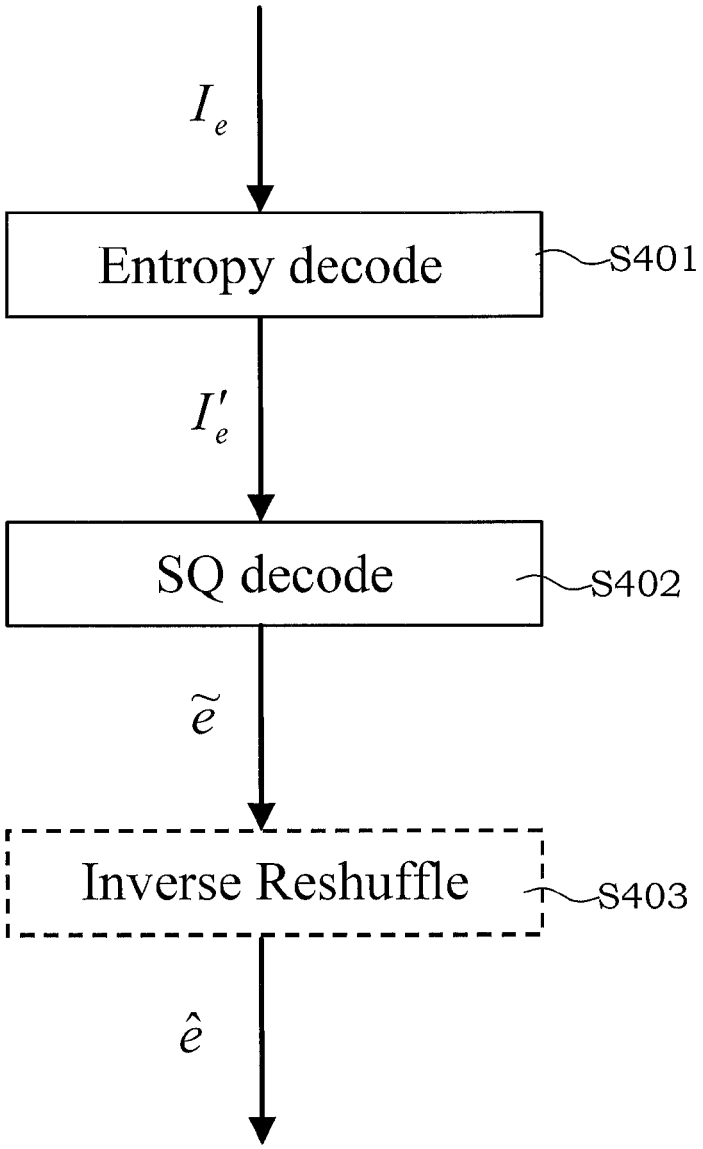
FIG. 5 is a flow chart of an embodiment of a method in a de-quantizer.

An embodiment of the excitation reconstruction algorithm or de-quantizer unit 400 in a decoder 200 is illustrated in FIG. 5. The optional re-shuffling operation is inverse to the one used in the encoder, so that the time-domain information is restored. According to a particular embodiment, the inverse re-shuffling operation can take place in the encoder, as indicated by the dotted boxes in FIG. 3 and FIG. 4, and thereby reduce the computational complexity of the decoder unit 200.

An overview of the processing steps of an embodiment of the HB decoder is shown in FIG. 9. Initially the quantization indices $I_e$ for the excitation signal are received at the decoder and the reconstructed excitation signal ê is generated, as indicated by the dotted box, in step S10. Subsequently, the reconstructed excitation signal is up sampled to provide the up sampled reconstructed excitation signal e'''. Further, the quantization indices $I_a$ for the quantized AR coefficients are received and used to filter and synthesize the up sampled reconstructed excitation signal, as indicated by the dotted box, in step S20. The synthesized waveform $\hat{s}_{HB}$ is generated by sending the up sampled excitation signal e''' through the synthesis filter according to Equation 4 below.

$$s'_{HB}(n) = A(z)^{-1} e'''(n), \tag{4}$$

Finally the waveform is up-scaled, as indicated by the dotted box, in step S30, with the received gain G (as represented by the received quantization indices $I_G$ for the gain G) to match the energy of the target HB waveform, to provide the output high frequency band part of the audio signal, as shown in Equation 5 below.

$$\hat{s}_{HB}(n) = \hat{G} \times s'_{HB}(n), \tag{5}$$

As mentioned previously, the embodiments of the described scheme for HB coding in the time domain can also be implemented on a signal transformed to some frequency domain representation, e.g., DFT, MDCT, etc. In this case, AR envelope can be replaced by band gains that resemble the spectrum envelope, and the excitation or residual signal can be obtained after normalization with such band gains. In such an embodiment, the re-shuffling operation may be done such that perceptually less important elements will be removed first. One possible such re-shuffling would be to simply reverse the residual in frequency, since lower frequencies are generally more perceptually relevant.

Figure 10:
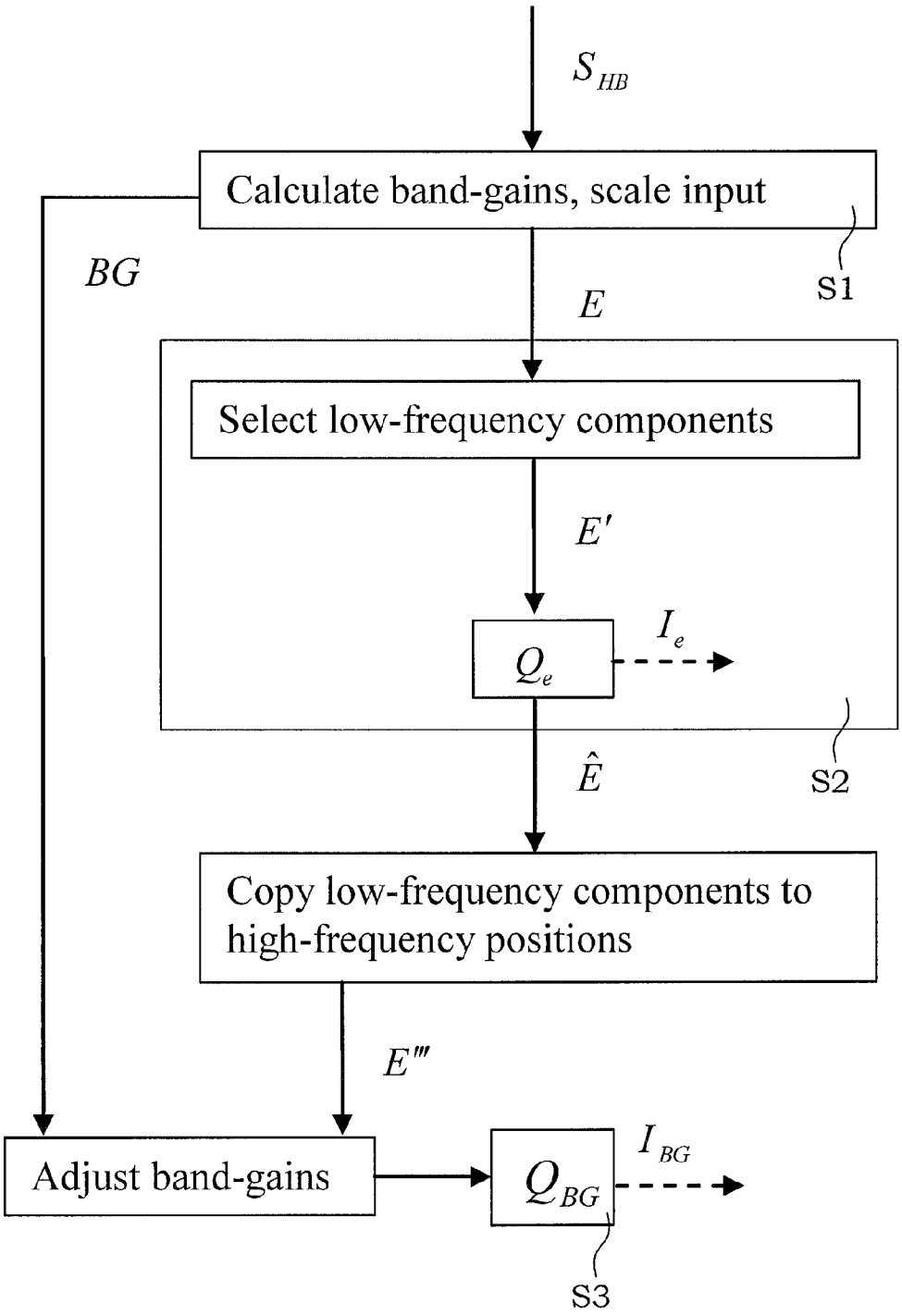
FIG. 10 is a flow chart of an embodiment of a frequency domain based method in an encoder.

With reference to FIG. 10, an embodiment of an encoding method in the frequency domain will be described below. In this case, the extracting step S1 includes extracting a set of band gains for an audio signal, wherein the band gains comprise the representation of a spectral envelope of the audio signal. Further, the excitation providing and quantizing step S2 includes providing and quantizing an excitation signal based on at least the extracted band gains and the audio signal. The quantization of the excitation signal is performed according to the previously described quantization method and is represented by $Q_e$ in FIG. 10. Subsequently, the gain providing and quantizing step S3 includes quantizing the set of band gains based on at least the excitation signal, the extracted band gains and the audio signal, and the transmitting step S4 includes transmitting quantization indices for the band gain coefficients and the excitation signal to a decoder unit.

In a corresponding manner to the decoding method described with reference to FIG. 7, in a method of decoding audio signals in the frequency domain, received quantization indices $I_e$ for an excitation signal are received in step S10 and de-quantized in block $Q_e^{-1}$ in FIG. 11 according to the previously described de-quantization method. For the thus reconstructed excitation signal $\hat{E}$ the low-frequency components are copied to high-frequency positions to reconstruct the spectral envelope and apply spectral shaping to provide a synthesized audio signal. Finally, in step S30, the band gains are reconstructed and applied to the synthesized audio signal to provide the decoded audio signal.

Processing steps in the frequency-domain encoder are illustrated in FIG. 10, which is alternative to time-domain processing from FIG. 8. In a frequency-domain approach the excitation signal E is calculated through scaling the transform coefficients S with band-gains BG (this step correspond to passing the waveform through a whitening filter in the time-domain approach). Down- and up-sampling operations are not needed, as the low-frequency components of the excitation vector can be directly selected.

Figure 11:
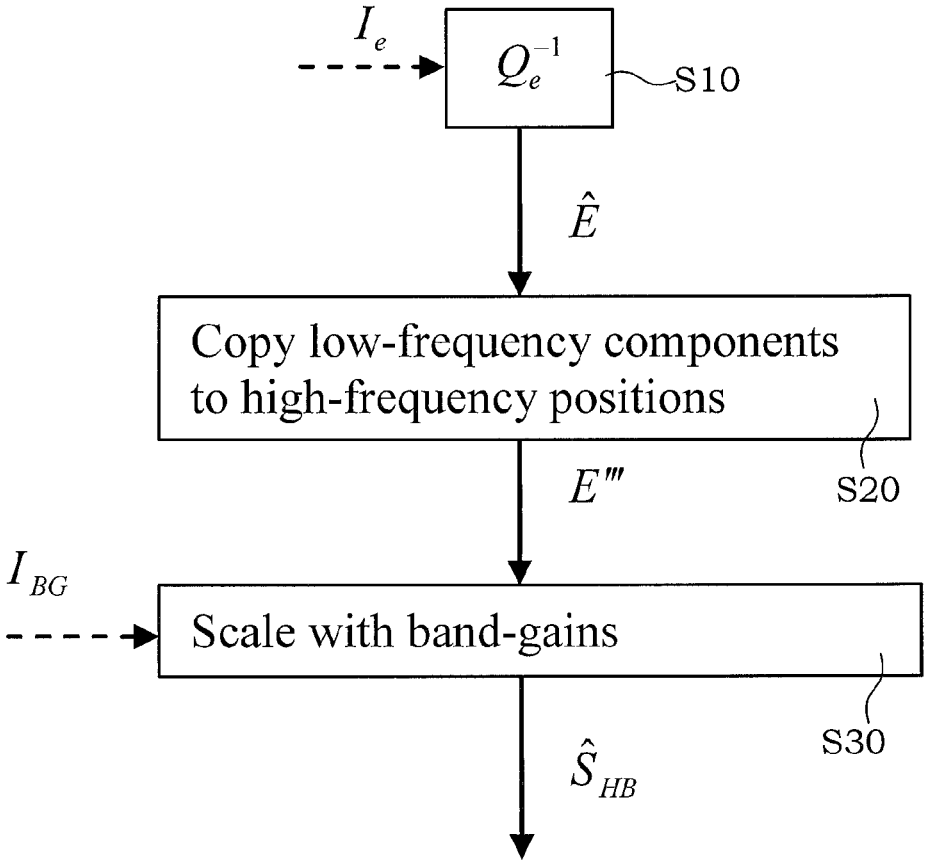
FIG. 11 is a flow chart of an embodiment of a frequency domain based method in a decoder.

Processing steps in the frequency-domain decoder are illustrated in FIG. 11, as alternative to FIG. 9. Similarly, to the time-domain approach, only quantization indices of the low-frequency part of the excitation vector are received at the decoder. In this case, high-frequency coefficients are generated by copying low-frequency coefficients.

Note that FIGS. 3 and 4 remain common for both time- and frequency-domain implementations, as the novel logic of the quantization/de-quantization scheme is the same for both implementations.

Arrangements according to the present disclosure will be described below with reference to FIG. 12-FIG. 21, as well as a few examples of computer implementations of embodiments related to MDCT and quantization within the time and frequency domain.

Figure 12:
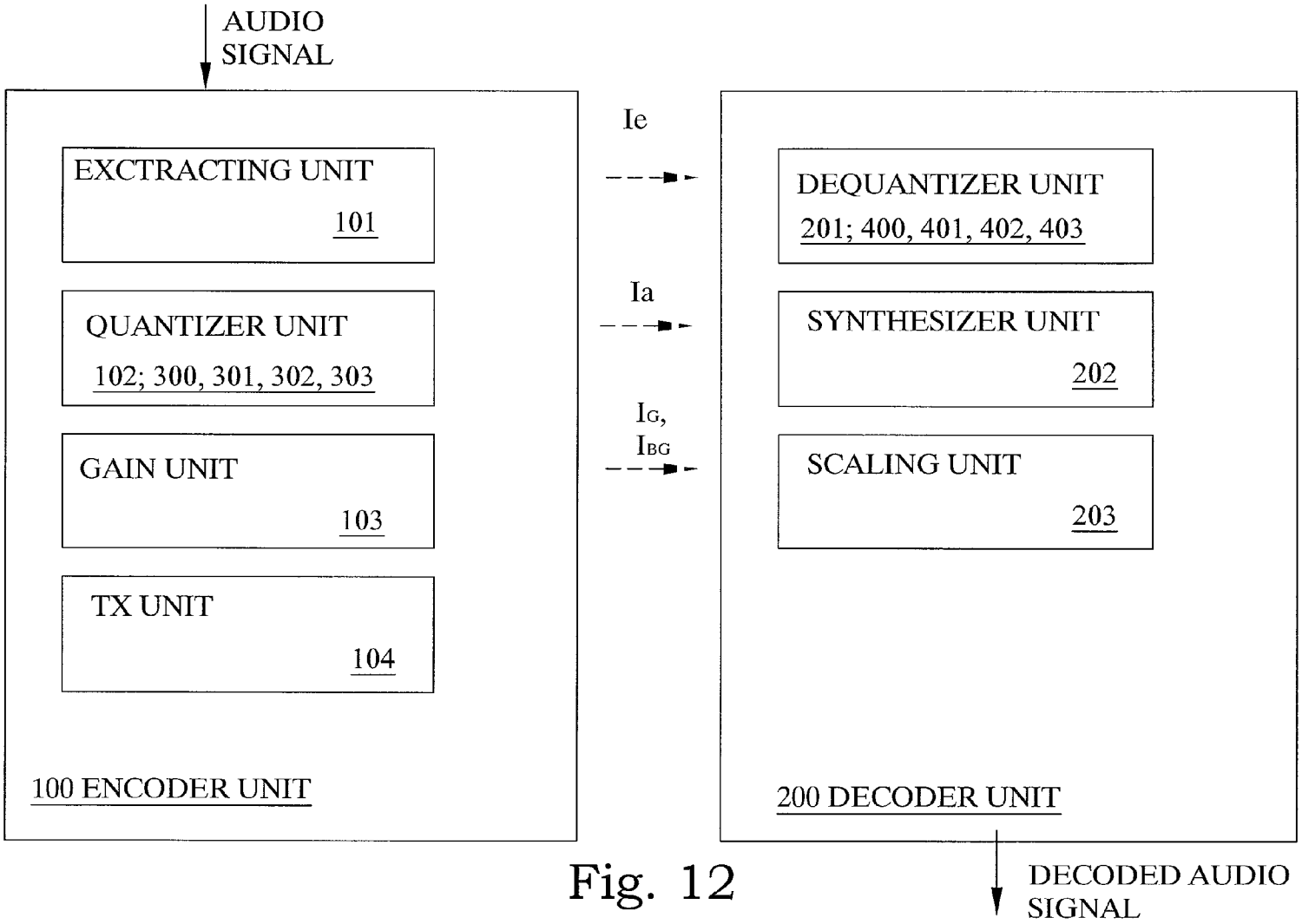
FIG. 12 is a block diagram illustrating example embodiments of a quantizer unit, de-quantizer unit, encoder, and decoder.

FIG. 12 illustrates an encoder unit 100 according to the present disclosure, which is configured for encoding signals e.g. audio signals, prior to transmission to a decoder unit 200 configured for decoding received signals to provide decoded signals e.g. decoded audio signals. Each unit is configured to perform the respective encoding or decoding method as described previously. The encoder arrangement or unit 101 includes an extracting unit 101, a quantizer unit 102, 303, 301, 302, 303, a gain unit 103 and a transmitting unit 104. The decoder unit 200 includes a de-quantizer unit 201, 400, 401, 402, 403, a synthesizer unit 202 and a scaling unit 203, the functionality of which will be described below. The respective arrangements 100, 200 can be located in a user terminal or a base station arrangement. The respective encoder 100 and decoder 200 arrangements can each be configured to operate in the time domain or the frequency domain. For both the time domain and the frequency domain, the quantizer unit or arrangement 102, 300, 301, 302, 303, and the de-quantizer unit or arrangement 201, 400, 401, 402, 403 operate in an identical manner. Consequently, the embodiments of the quantizer and de-quantizer can be implemented in any type of unit that requires quantization or de-quantization of an excitation signal, regardless of in which particular unit or surroundings or situation it takes place. However, the remaining functional units 101, 103, 104 of the encoder 100 and 202, 203 of the decoder unit 200 differ somewhat in their functionally but still within a common general encoding and decoding method respectively as described previously.

Figure 13:
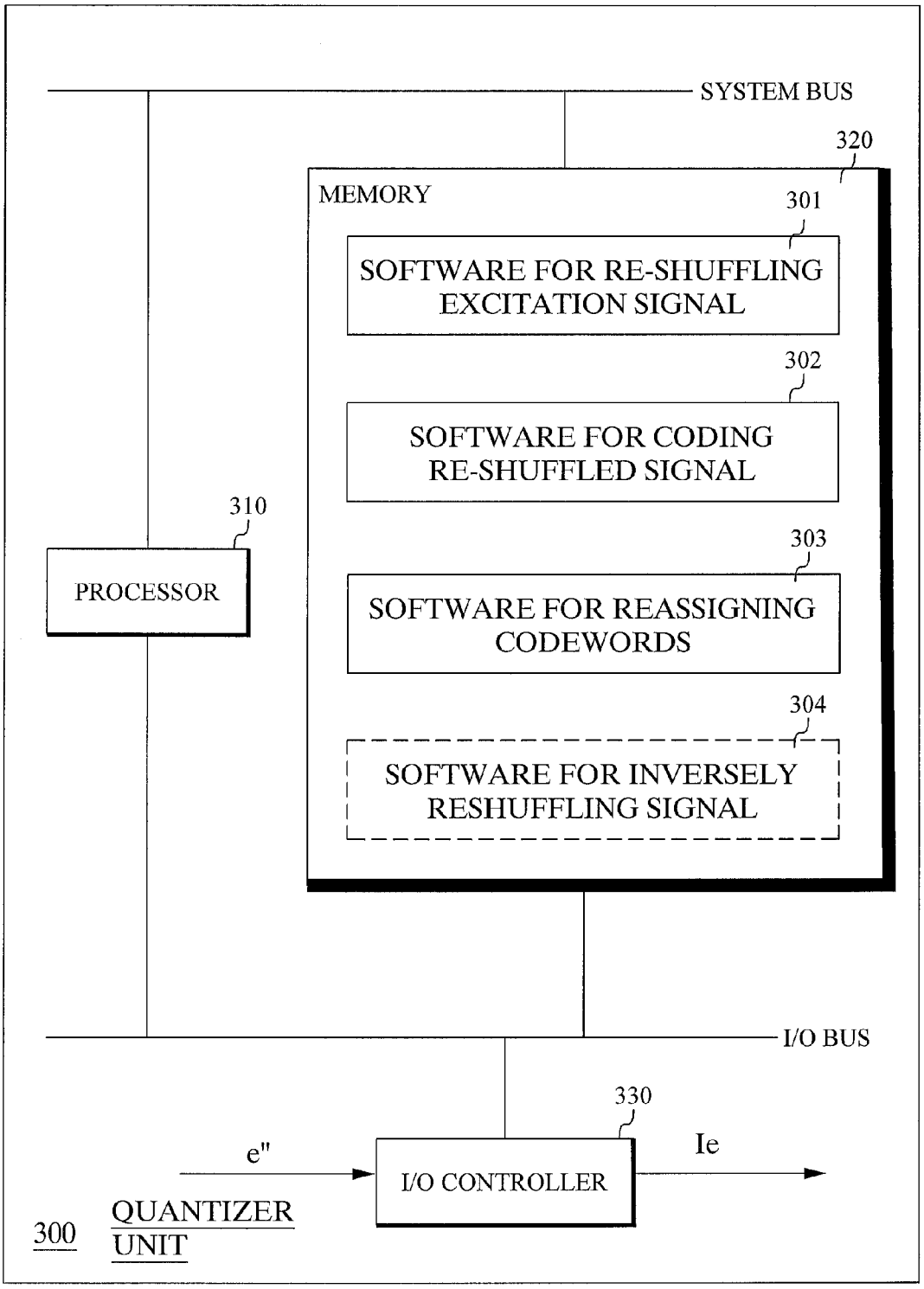
FIG. 13 is a block diagram illustrating an example embodiment of a quantizer unit.

With reference to FIG. 13 an embodiment of a quantizer unit 102, 300 for quantizing a received excitation signal in a communication system will be described. The quantizer unit 103, 300, includes a re-shuffling unit 301 configured for re-shuffling the elements of the received excitation signal to provide a re-shuffled excitation signal, and a coding unit 302 configured for coding the re-shuffled excitation signal with a variable bit-rate algorithm to provide a coded excitation signal. Finally, the quantizer 102, 300 includes a reassigning unit 304 configured for re assigning codewords of the coded excitation signal if a number of used bits exceeds a predetermined fixed bit rate requirement. According to a further embodiment, the coding unit 302 is configured to and includes a unit 302' configured for SQ coding the re-shuffled excitation signal and a unit 302" configured for entropy coding the SQ coded re-shuffled excitation signal. In a further optional embodiment, the quantizer 102, 300 includes an inverse re-shuffling unit 305 configured for inversely re-shuffling the elements of the coded excitation signal after codeword reassignment.

Figure 14:
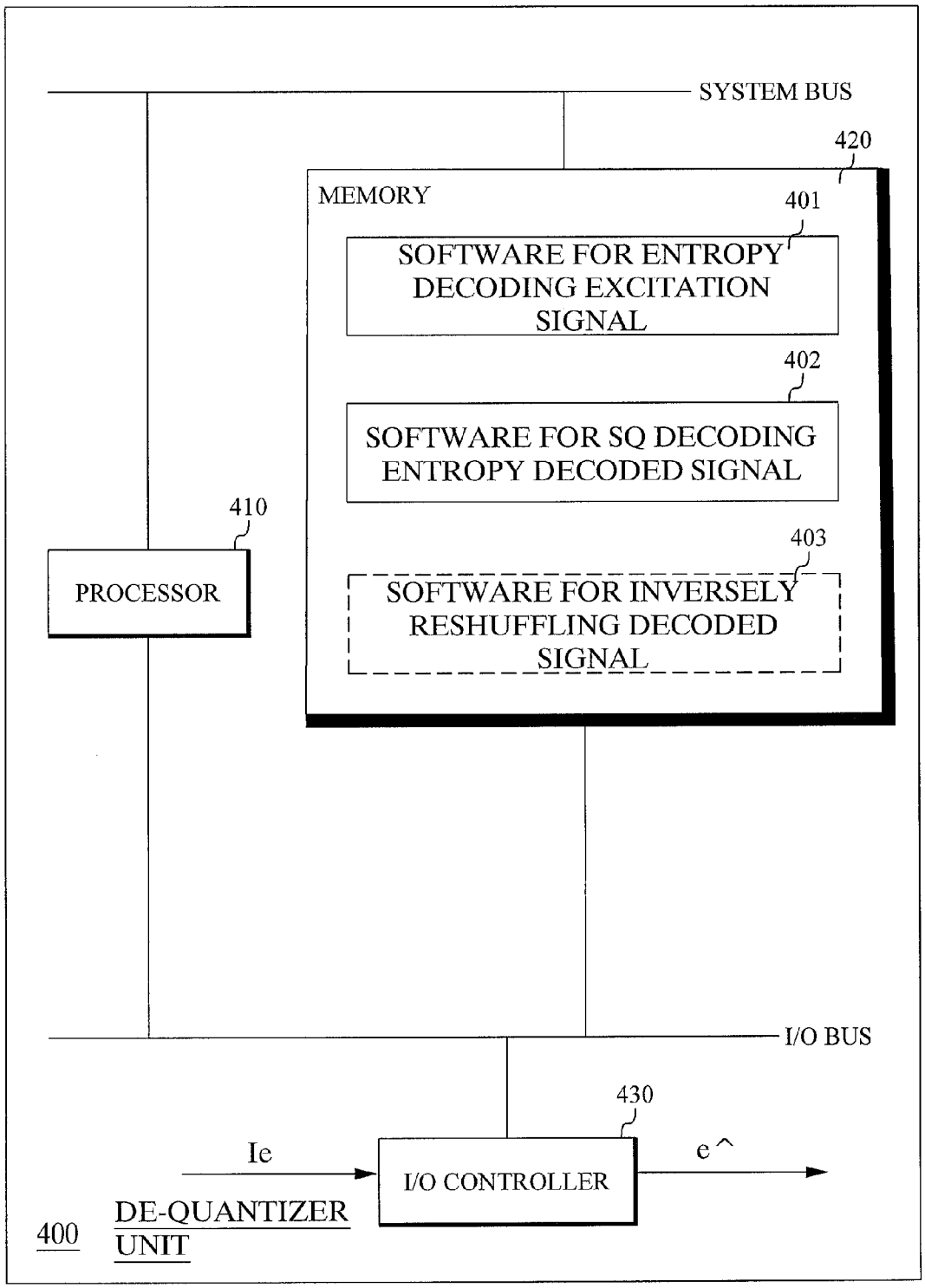
FIG. 14 is a block diagram illustrating an example embodiment of a de-quantizer unit for use together with the quantizer of FIG. 13.

With reference to FIG. 14, a de-quantizer unit 201, 400 for reconstructing excitation signals in a communication system will be described. The de-quantizer 201, 400 is configured for reconstructing excitation signals that have been quantized according to the preciously described quantizer unit 102, 300. Consequently, the de-quantizer arrangement or unit 201, 401 includes a decoding unit configured for and further including a decoder unit 401 configured for entropy decoding a received quantized excitation signal and a SQ decoding unit 402 configured for SQ decoding the entropy decoded excitation signal to provide a reconstructed excitation signal. Also, the de-quantizer unit includes an inverse re-shuffling unit 403 configured for inversely re-shuffling elements of the reconstructed excitation signal, if the elements of the reconstructed excitation signal has been previously re-shuffled in a quantizer unit 102, 300 in an encoder 100.

Figure 15:
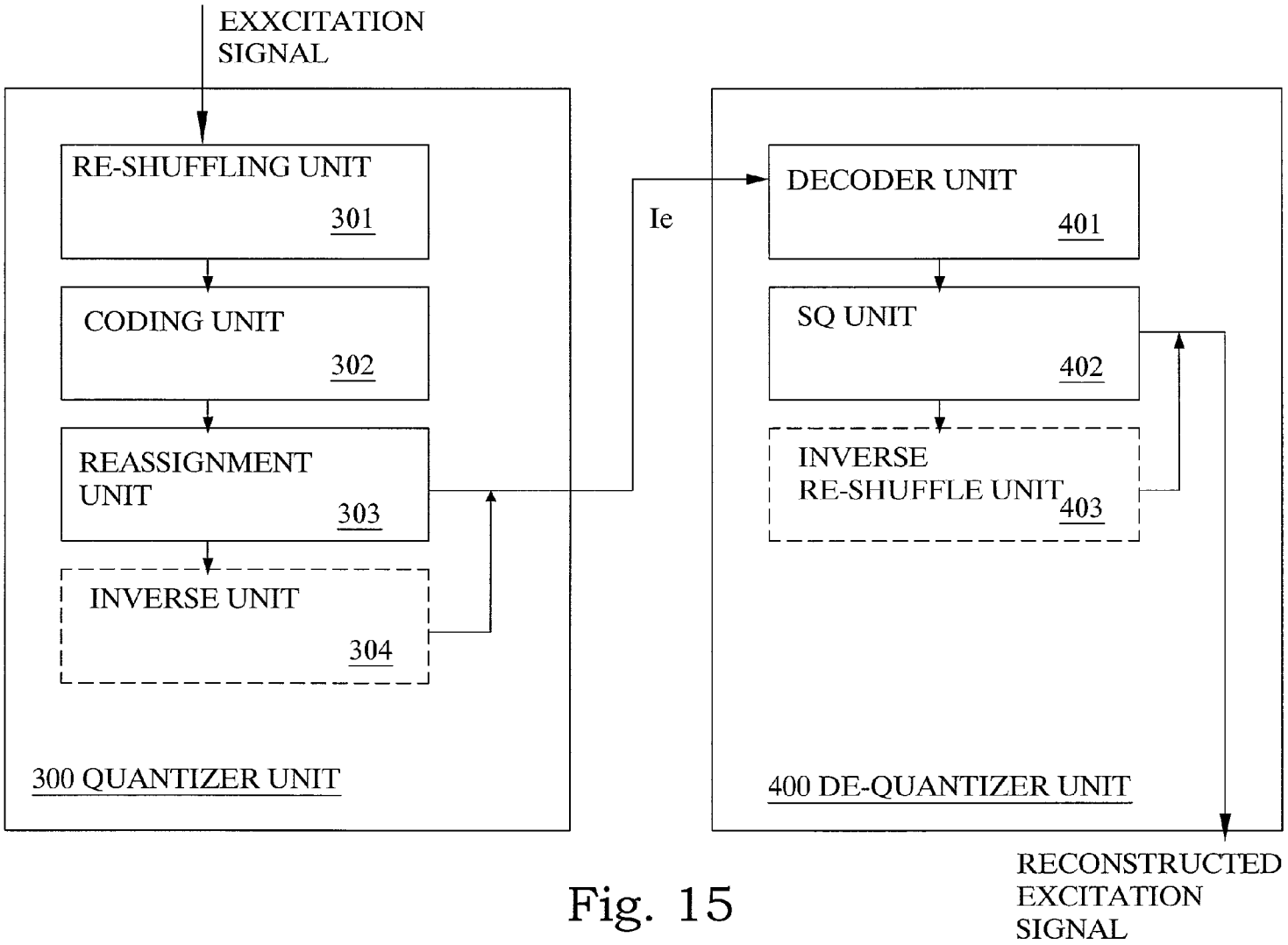
FIG. 15 is a block diagram illustrating example embodiments of a quantizer unit and a de-quantizer unit.

Further embodiments of a quantizer unit 300 and a de-quantizer unit 400 according to the present technology are illustrated in FIG. 15.

Figure 16:
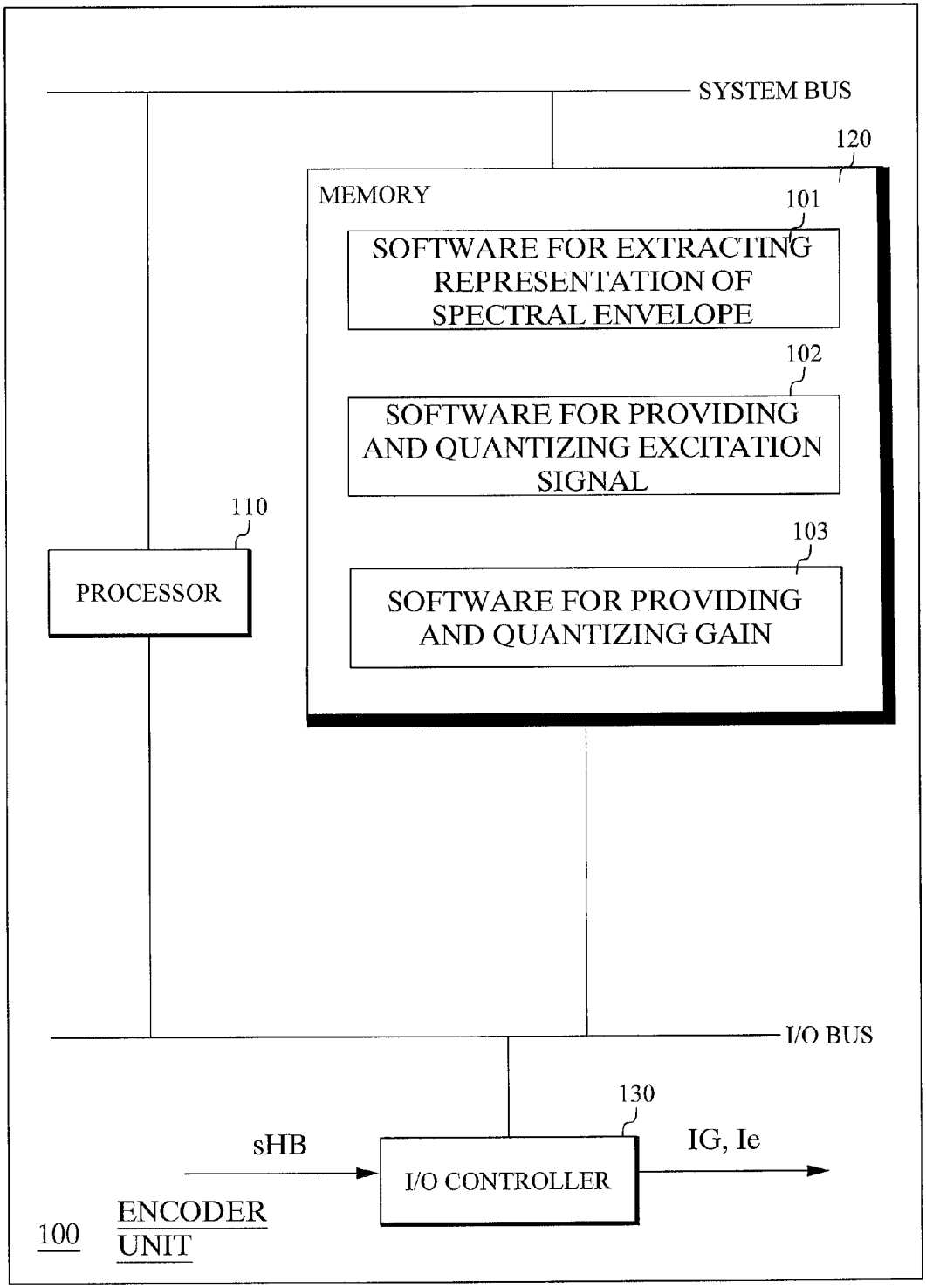
FIG. 16 is a block diagram illustrating an example embodiment of an encoder unit.
Figure 17:
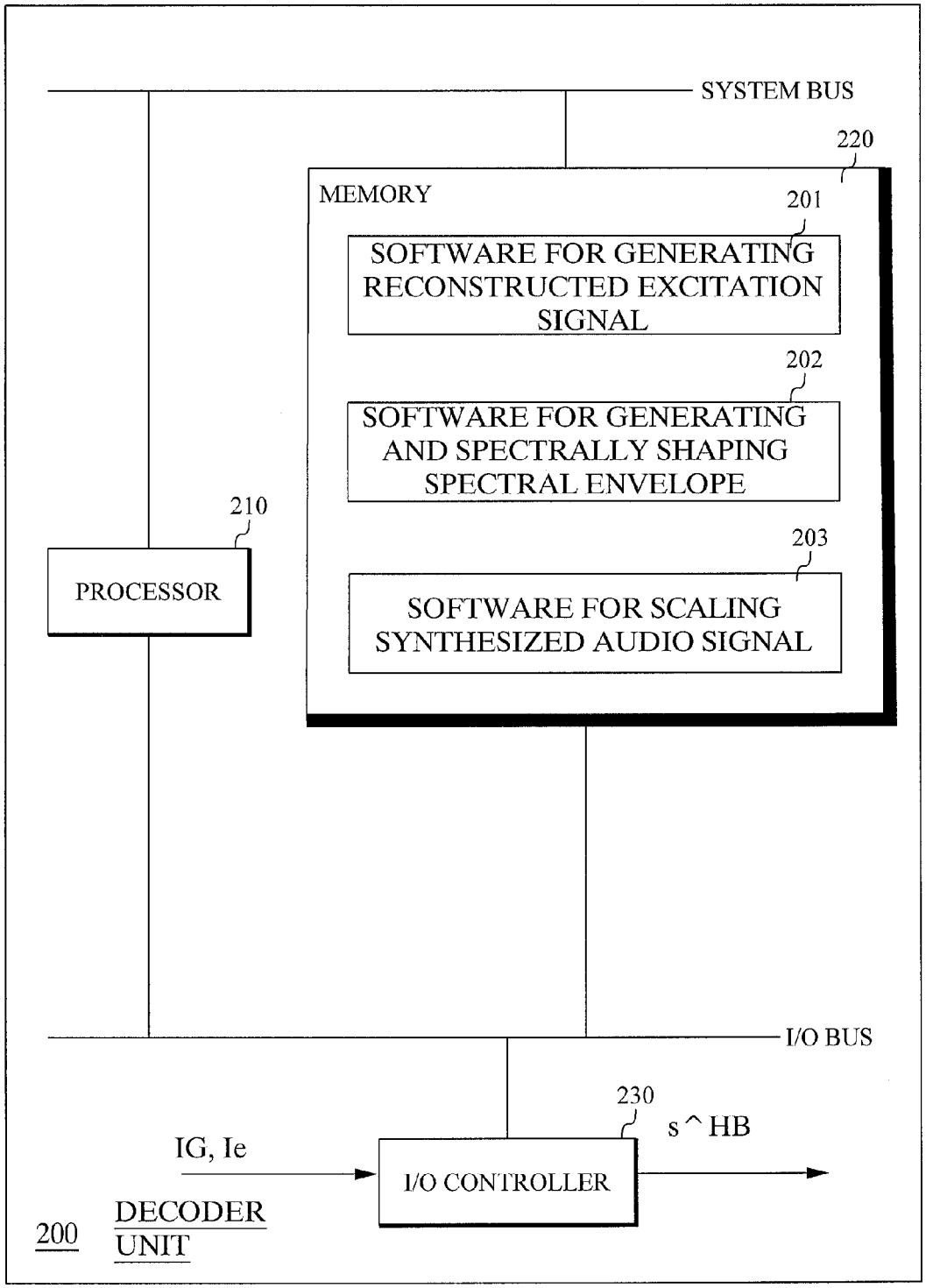
FIG. 17 is a block diagram illustrating an example embodiment of a decoder unit for use together with the encoder of FIG. 16.

As mentioned previously, the above described quantizer unit 102, 300 is beneficially implemented in an encoder unit, embodiments of which will be further described with reference to FIGS. 16, 17 and 19.

A general embodiment of the encoder unit 100 includes a quantizer 102, 300 as described previously, and further includes an extracting unit 101 configured for extracting a representation of a spectral envelope of an audio signal, and the quantizer unit 300 is configured for providing and quantizing an excitation signal based on at least that representation of the spectral envelope and the audio signal. Further, the encoder 100 includes a gain unit 103 configured for providing and quantizing S3 a gain based on at least the excitation signal, the provided representation and the audio signal, and a transmitting unit 104 configured for transmitting quantization S4 indices for at least the quantized gain and the quantized excitation signal to a decoder unit.

Figure 18:
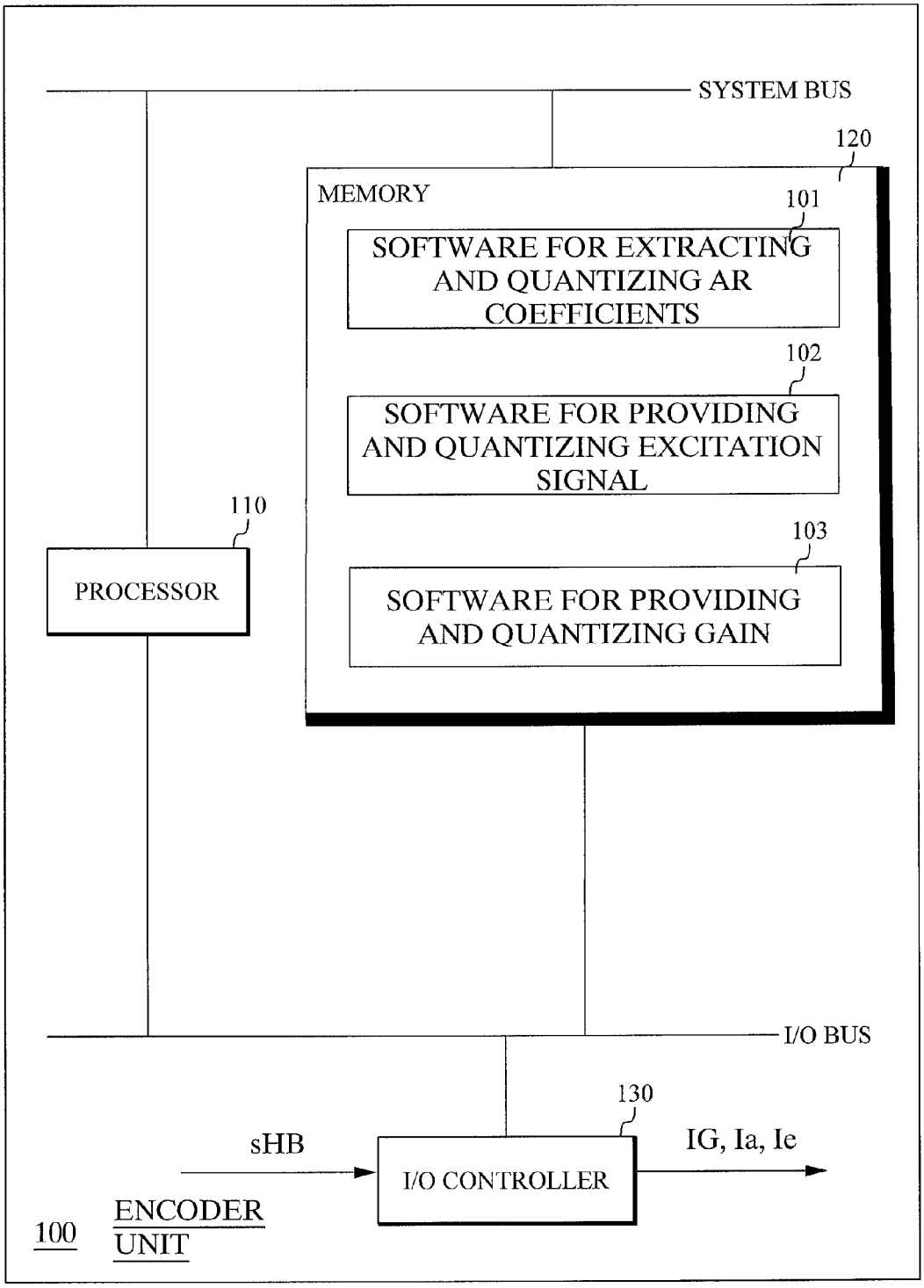
FIG. 18 is a block diagram illustrating an example embodiment of an encoder unit for use in the time domain.

According to FIG. 18, the encoder is configured for operating in the time domain and the extracting unit 101 is configured for extracting and quantizing AR coefficients as the representation of the spectral envelope of the audio signal, and the quantizer unit 102,300 is configured for providing and quantizing an excitation signal based on at least the quantized auto regression coefficients and the received audio signal. In addition, the gain unit 103 is configured for providing and quantizing a gain based on at least the excitation signal, the quantized auto regression coefficients and the received audio signal, and the transmitter unit 104 is configured for transmitting quantization indices for the auto regression coefficients, the excitation signal and the gain to a decoder unit 200.

According to FIG. 18, an embodiment of the encoder unit 100 is configured for operating in the frequency domain and the extracting unit 101 is configured for extracting a set of band gains as the representation of a spectral envelope for the audio signal. Further, the quantizer unit 102, 300 is configured for providing and quantizing an excitation signal based on at least the extracted band gains and the received audio signal. In addition the gain unit 103 is configured for quantizing the extracted set of band gains based on at least the excitation signal, the extracted band gains and the received audio signal. Finally, the transmitter unit 104 is configured for transmitting quantization indices for the band gain coefficients and the excitation signal to a decoder unit 200.

Figure 20:
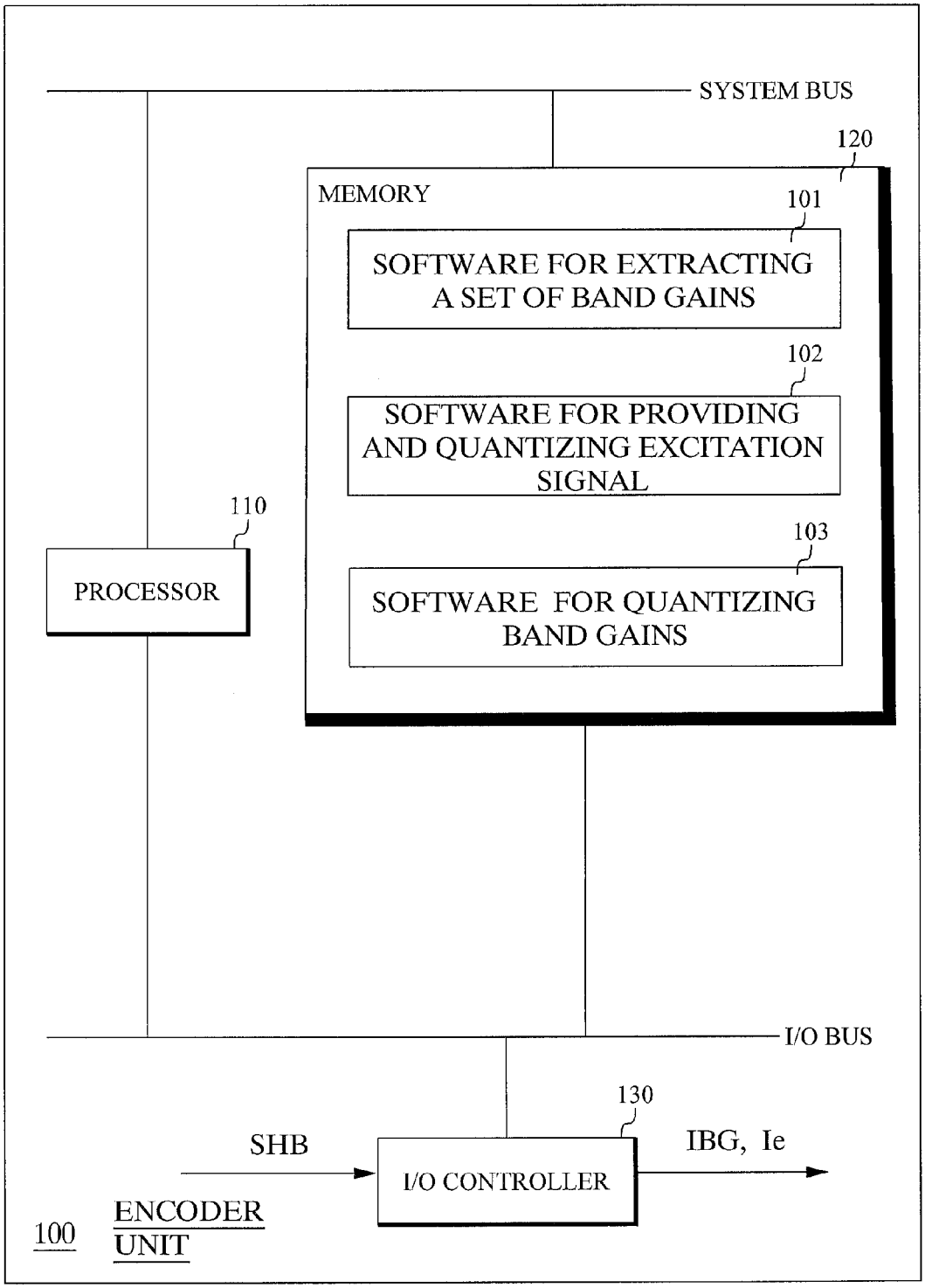
FIG. 20 is a block diagram illustrating an example embodiment of an encoder unit in the frequency domain.

As mentioned previously, the above described de-quantizer unit 201, 400 is beneficially implemented in a decoder unit 200, embodiments of which will be further described with reference to FIGS. 17, 18 and 20.

A general embodiment of the decoder unit 200 includes a de-quantizer unit 201, 400 as described previously. Further, the de-quantizer unit 400, 201 is configured for generating a reconstructed excitation signal based on received quantization indices for the excitation signal. The decoder 200 further includes a generating unit 202 configured for generating and spectrally shaping a reconstructed representation of a spectral envelope of the audio signal based on the generated reconstructed signal and received quantizer representation of a spectral envelope of the audio signal, to provide a synthesized audio signal. In addition, the decoder 400 includes a scaling unit 203 configured for up-scaling the synthesized audio signal based on received quantization indices for a gain, to provide a decoded audio signal.

Figure 19:
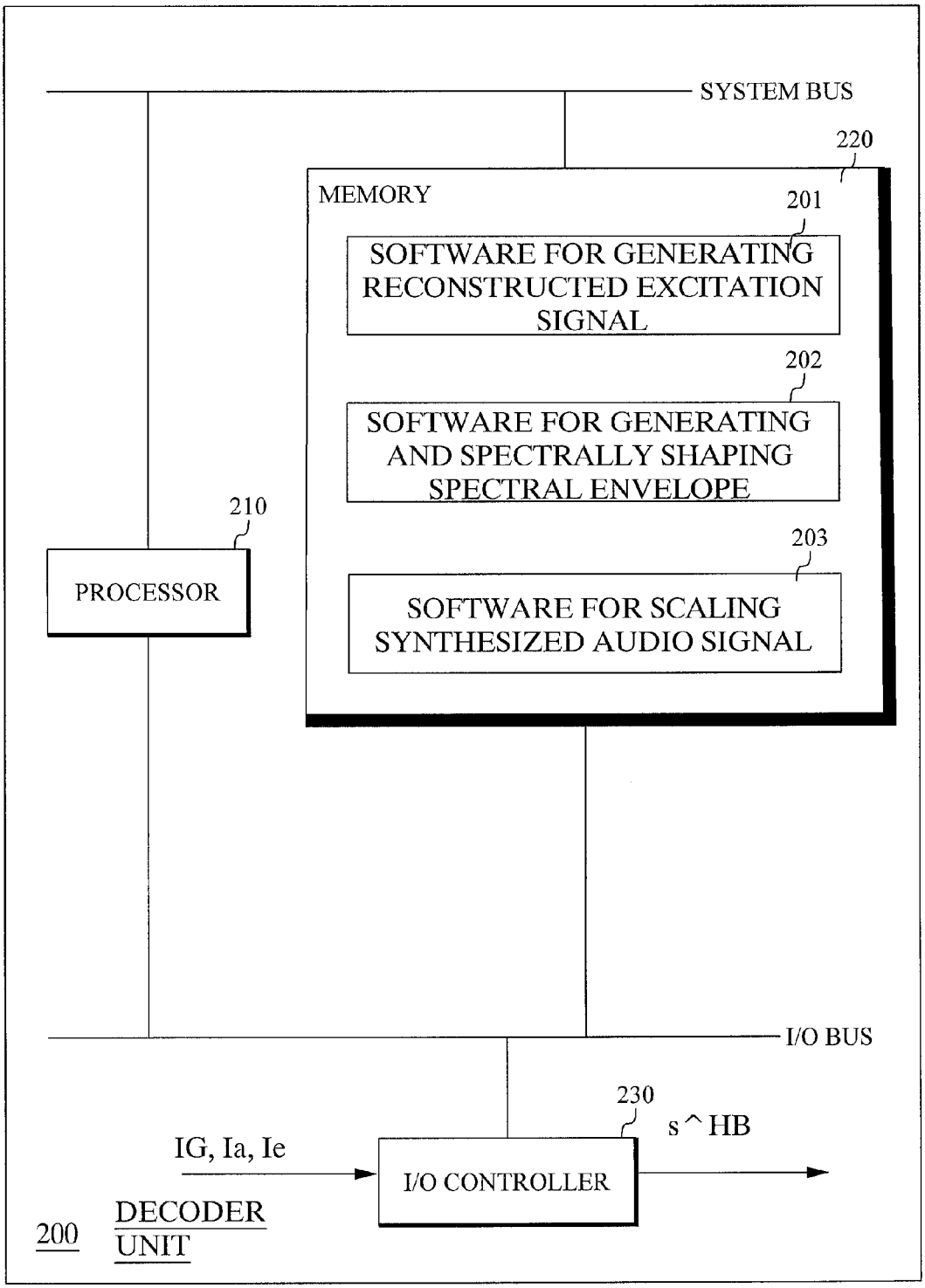
FIG. 19 is a block diagram illustrating an example embodiment of a decoder unit for use together with the encoder of FIG. 18.

With reference to FIG. 19, an embodiment of the decoder 200 configured to operate in the time domain will be described. The generating unit 202 is configured for generating and spectrally shaping the reconstructed representation of the spectral envelope based on the generated reconstructed excitation signal and received quantized auto regression coefficients as the representation of the spectral envelope, and the scaling unit 203 is configured for up-scaling the synthesized audio signal based on received quantization indices for a gain, to provide the decoded audio signal.

Figure 21:
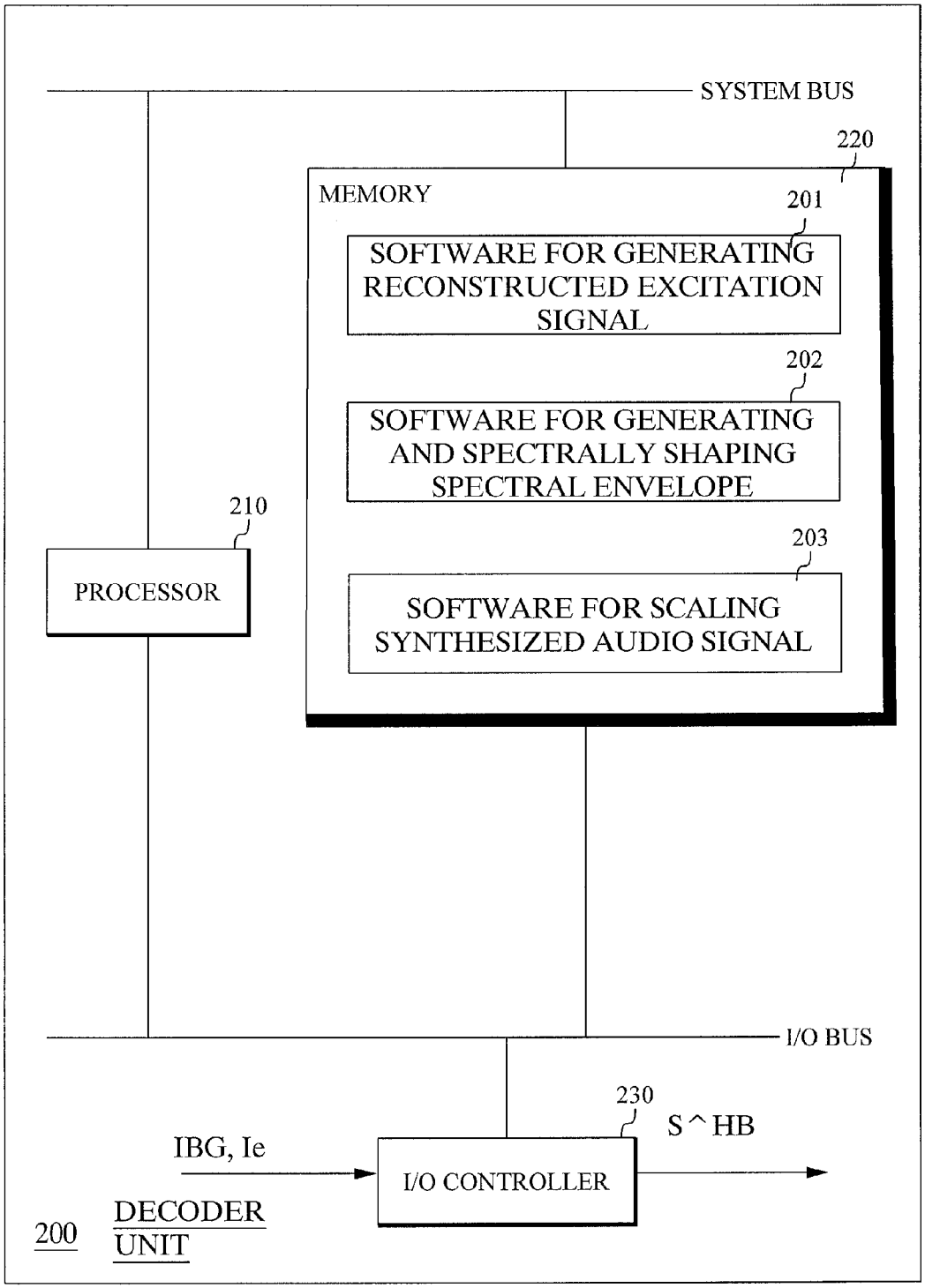
FIG. 21 is a block diagram illustrating an example embodiment of a decoder unit for use together with the encoder of FIG. 19.

With reference to FIG. 21, an embodiment of the decoder 200 configured to operate in the frequency domain will be described. Consequently, the generating unit 202 is configured for generating and spectrally shaping the reconstructed representation of the spectral envelope based on the generated reconstructed excitation signal, and the scaling unit 203 is configured for up-scaling the synthesized audio signal based on received quantization indices for band gains, to provide the decoded audio signal.

In the following, an example of an embodiment of a quantizer unit 300 in an encoder unit 100 will be described with reference to FIG. 13. This embodiment is based on a processor 310, for example a micro processor, which executes a software component 301 for re-shuffling the elements of a received excitation signal, a software component 302 for SQ and entropy encoding the re-shuffled excitation signal, and a software component 303 for reassigning the codewords of the encoded re-shuffled excitation signal. Optionally, the quantizer unit 300 includes a further software component 304 for inversely re-shuffling the excitation signal after codeword reassignment. These software components are stored in memory 320. The processor 310 communicates with the memory over a system bus. The audio signal is received by an input/output (I/O) controller 330 controlling an I/O bus, to which the processor 310 and the memory 320 are connected. In this embodiment, the audio signal received by the I/O controller 330 are stored in the memory 320, where they are processed by the software components. Software component 301 may implement the functionality of the re-shuffling step S301 in the embodiment described with reference to FIG. 3 and FIG. 4 above. Software component 302 may implement the functionality of the encoding step S302 including optional SQ encoding step S302' and entropy coding step S302" in the embodiment described with reference to FIG. 3 and FIG. 4 above. Software component 303 may implement the functionality of the codeword reassignment loop S303 in the embodiment described with reference to FIG. 3 and FIG. 4 above.

The I/O unit 330 may be interconnected to the processor 310 and/or the memory 320 via an I/O bus to enable input and/or output of relevant data such as input parameter(s) and/or resulting output parameter(s).

In the following, and example of an embodiment of a de-quantizer unit 400 in a decoder 200 will be described with reference to FIG. 14. This embodiment is based on a processor 410, for example a micro processor, which executes a software component 401 for entropy decoding a received excitation signal, a software component 402 for SQ decoding the entropy decoded excitation signal, and an optional software component 403 for inversely re-shuffling the elements of the decoded excitation signal. These software components are stored in memory 420. The processor 410 communicates with the memory over a system bus. The audio signal is received by an input/output (I/O) controller 430 controlling an I/O bus, to which the processor 410 and the memory 420 are connected. In this embodiment, the audio signal received by the I/O controller 430 are stored in the memory 420, where they are processed by the software components. Software component 401 may implement the functionality of the entropy decoding step S401 in the embodiment described with reference to FIG. 5 above. Software component 402 may implement the functionality of the SQ decoding step S402 in the embodiment described with reference to FIG. 5 above. Optional software component 403 may implement the functionality of the optional inverse re-shuffle step S403 in the embodiment described with reference to FIG. 5 above.

The I/O unit 430 may be interconnected to the processor 410 and/or the memory 420 via an I/O bus to enable input and/or output of relevant data such as input parameter(s) and/or resulting output parameter(s).

In the following, an example of an embodiment of an encoder unit 100 will be described with reference to FIG. 15, FIG. 18, and FIG. 20. This embodiment is based on a processor 110, for example a micro processor, which executes a software component 101 for extracting and quantizing representations of the scalar envelope of an audio signal e.g. auto regression coefficients or band gain coefficients of a filtered received audio signal, a software component 102 for providing and quantizing an excitation signal based on the quantized representation of the spectral envelope e.g. auto regression coefficients and the filtered received audio signal, and a software component 103 for providing and quantizing a gain based on the excitation signal, the quantized representation of the spectral envelope e.g. auto regression coefficients and the filtered received audio signal. These software components are stored in memory 120. The processor 110 communicates with the memory over a system bus. The audio signal is received by an input/output (I/O) controller 130 controlling an I/O bus, to which the processor 110 and the memory 120 are connected. In this embodiment, the audio signal received by the I/O controller 130 are stored in the memory 120, where they are processed by the software components. Software component 101 may implement the functionality of step S1 in the embodiment described with reference to FIG. 6, FIG. 8, and FIG. 10 above. Software component 102 may implement the functionality of step S2 in the embodiment described with reference to FIG. 6, FIG. 8, and FIG. 10 above. Software component 103 may implement the functionality of step S3 in the embodiment described with reference to FIG. 6, FIG. 8 and FIG. 10 above.

The I/O unit 130 may be interconnected to the processor 110 and/or the memory 120 via an I/O bus to enable input and/or output of relevant data such as input parameter(s) and/or resulting output parameter(s).

In the following, an example of an embodiment of a decoder unit 200 will be described with reference to FIG. 17, FIG. 19, and FIG. 21. This embodiment is based on a processor 210, for example a micro processor, which executes a software component 201 for generating or reconstructing a received excitation signal, a software component 202 for synthesizing the reconstructed excitation signal, and a software component 203 for up-scaling the synthesized audio signal. These software components are stored in memory 220. The processor 210 communicates with the memory over a system bus. The audio signal is received by an input/output (I/O) controller 230 controlling an I/O bus, to which the processor 210 and the memory 220 are connected. In this embodiment, the audio signal received by the I/O controller 230 are stored in the memory 220, where they are processed by the software components. Software component 201 may implement the functionality of step S10 in the embodiment described with reference to FIG. 5 above. Software component 102 may implement the functionality of step S20 in the embodiment described with reference to FIG. 5 above.

Software component 103 may implement the functionality of step S30 in the embodiment described with reference to FIG. 5 above.

The I/O unit 230 may be interconnected to the processor 210 and/or the memory 220 via an I/O bus to enable input and/or output of relevant data such as input parameter(s) and/or resulting output parameter(s).

At least some of the steps, functions, procedures, and/or blocks described above may be implemented in software for execution by a suitable processing device, such as a microprocessor, Digital Signal Processor (DSP) and/or any suitable programmable logic device, such as a Field Programmable Gate Array (FPGA) device.

It should also be understood that it might be possible to re-use the general processing capabilities of the network nodes. For example this may, be performed by reprogramming of the existing software or by adding new software components.

The software may be realized as a computer program product, which is normally carried on a computer-readable medium. The software may thus be loaded into the operating memory of a computer for execution by the processor of the computer. The computer/processor does not have to be dedicated to only execute the above-described steps, functions, procedures, and/or blocks, but may also execute other software tasks.

The technology described above is intended to be used in an audio encoder and decoder, which can be used in a mobile device (e.g. mobile phone, laptop) or a stationary PC. However, it can be equally adapted to be used in an image encoder and decoder.

The presented quantization scheme allows low-complexity scalable coding of received signals, in particular but not limited to HB audio signals. In particular, it enables an efficient and low cost utilization of variable bit rate schemes within a fixed bit rate framework. In this way, it overcomes the limitations of quantization in e.g. the conventional BWE schemes in the time domain as well as MDCT schemes in the frequency domain.

The embodiments described above are to be understood as a few illustrative examples. It will be understood by those skilled in the art that various modifications, combinations and changes may be made to the embodiments without departing from the scope of the present embodiments. In particular, different part solutions in the different embodiments can be combined in other configurations, where technically possible. The scope of the present invention is, however, defined by the appended claims.

The invention claimed is:

1. A quantization method for quantizing a received excitation signal in a communication system, comprising:

re-shuffling the elements of the received excitation signal to provide a re-shuffled excitation signal;

coding the re-shuffled excitation signal with a variable bit-rate algorithm to provide a coded excitation signal, wherein the coded excitation signal is quantized with respect to a plurality of amplitude level; and reassigning codewords of the coded excitation signal if a number of used bits exceeds a predetermined fixed bit rate requirement to provide a quantized excitation signal, wherein:

reassigning codewords comprises modifying codeword lengths based on probabilities for each of the plurality of amplitude levels occurring, and a shorter codeword length corresponds with a higher probability of an amplitude level occurring.

2. The quantization method according to claim 1, comprising performing said coding step on the elements of the received excitation signal and prior to performing said re-shuffling step on the coded excitation signal.

3. The quantization method according to claim 1, wherein coding the re-shuffled excitation signal comprises both SQ coding and entropy coding the re-shuffled excitation signal.

4. The quantization method according to claim 3, further comprising inversely re-shuffling the coded excitation signal after reassigning codewords of the coded excitation signal.

5. An encoding method in a communication system, comprising:

extracting a representation of a spectral envelope of an audio signal;

providing and quantizing an excitation signal based on at least the representation and the audio signal, the quantization being performed according to claim 1;

providing and quantizing a gain for the audio signal based on at least the excitation signal, the provided representation and the audio signal;

transmitting quantization indices for at least the quantized gain and the quantized excitation signal to a decoder.

6. The encoding method according to claim 5, wherein:

encoding takes place in the time domain;

extracting the representation of the spectral envelope comprises extracting and quantizing a set of auto regression coefficients for the audio signal, wherein the set of auto regression coefficients comprise the representation of the spectral envelope of the audio signal;

providing and quantizing the excitation signal is based on at least the quantized auto regression coefficients and the audio signal;

providing and quantizing the gain is based on at least the excitation signal, the quantized AR coefficients, and the audio signal;

transmitting quantization indices comprises transmitting quantization indices for the auto regression coefficients, the excitation signal, and the gain to the decoder.

7. The encoding method according to claim 5, wherein:

encoding takes place in the frequency domain;

extracting the representation of the spectral envelope comprises extracting a set of band gains for the audio signal, wherein the band gains comprise the representation of the spectral envelope of the audio signal;

providing and quantizing the excitation signal is based on at least the extracted band gains and the audio signal;

providing and quantizing the set of band gains is based on at least the excitation signal, the extracted band gains, and the audio signal;

transmitting quantization indices comprises transmitting quantization indices for the band gain coefficients and the excitation signal to the decoder.

8. A quantizer for quantizing a received excitation signal a communication system, comprising one or more processors configured for:

re-shuffling the elements of the received excitation signal to provide a re-shuffled excitation signal;

coding the re-shuffled excitation signal with a variable bit-rate algorithm to provide a coded excitation signal, wherein the coded excitation signal is quantized with respect to a plurality of amplitude levels; and reassigning codewords of the coded excitation signal if a number of used bits exceeds a predetermined fixed bit rate requirement, wherein:

reassigning codewords comprises modifying codeword lengths based on probabilities for each of the plurality of amplitude levels occurring, and a shorter codeword length corresponds with a higher probability of an amplitude level occurring.

9. The quantizer according to claim 8, wherein the one or more processors are configured for:

SQ coding the re-shuffled excitation signal, and entropy coding the SQ coded re-shuffled excitation signal.

10. The quantizer according to claim 8, wherein the one or more processors are configured for inversely re-shuffling the elements of the coded excitation signal after reassigning codewords of the coded excitation signal.

11. An encoder comprising one or more processors configured for:

implementing a quantizer according to claim 8, wherein the quantizer is configured for providing and quantizing an excitation signal based on at least a representation of a spectral envelope of an audio signal and the audio signal;

extracting the representation of the spectral envelope of the audio signal;

providing and quantizing a gain based on at least the excitation signal, the provided representation and the audio signal; and transmitting quantization indices for at least the quantized gain and the quantized excitation signal to a decoder.

12. The encoder according to claim 11, wherein the one or more processors are configured for:

operating in the time domain;

extracting and quantizing AR coefficients as the representation of the spectral envelope of the audio signal;

providing and quantizing an excitation signal based on at least the quantized auto regression coefficients and the received audio signal;

providing and quantizing a gain based on at least the excitation signal, the quantized auto regression coefficients, and the received audio signal;

transmitting quantization indices for the auto regression coefficients, the excitation signal, and the gain to a decoder.

13. The encoder according to claim 11, wherein the one or more processors are configured for:

operating in the frequency domain;

extracting a set of band gains as the representation of the spectral envelope for the audio signal;

providing and quantizing an excitation signal based on at least the extracted band gains and the received audio signal;

quantizing the set of band gains based on at least the excitation signal, the extracted band gains, and the received audio signal;

transmitting quantization indices for the band gain coefficients and the excitation signal to a decoder.

14. A user terminal comprising a quantizer according to claim 8.

15. A de-quantization method for reconstructing an excitation signal in a communication system, comprising:

entropy decoding a received quantized excitation signal, wherein:

the received quantized excitation signal is quantized with respect to a plurality of amplitude levels, the length of codewords of the received quantized excitation signal are based on probabilities for each of the plurality of amplitude levels occurring, and a shorter codeword length corresponds with a higher probability of an amplitude level occurring;

SQ decoding the entropy decoded excitation signal to provide the reconstructed excitation signal, and inversely re-shuffling the elements of the reconstructed excitation signal.

16. The method according to claim 15, wherein inversely re-shuffling step is performed when the elements of the reconstructed excitation signal have been previously re-shuffled in a quantizer.

17. A decoder comprising one or more processors configured for:

implementing a de-quantizer according to claim 16, wherein the de-quantizer, is further configured for generating a reconstructed excitation signal based on received quantization indices for the excitation signal;

generating and spectrally shaping a reconstructed representation of a spectral envelope of an audio signal based at least on the generated reconstructed excitation signal and a received quantized representation of a spectral envelope of the audio signal to provide a synthesized audio signal;

scaling the synthesized audio signal based on received quantization indices for a gain to provide a decoded audio signal.

18. The decoder according to claim 17, wherein the one or more processors are configured for:

operating in the time domain;

generating and spectrally shaping the reconstructed representation of the spectral envelope based on the generated reconstructed excitation signal and received quantizer auto regression coefficients as the representation of the spectral envelope, and scaling the synthesized audio signal based on received quantization indices for a gain to provide the decoded audio signal.

19. The decoder according to claim 17, wherein the one or more processors are configured for:

operating in the frequency domain;

generating and spectrally shaping the reconstructed representation of the spectral envelope based on the generated reconstructed excitation signal, and scaling the synthesized audio signal based on received quantization indices for band gains to provide the decoded audio signal.

20. A decoding method in a communication system, comprising:

generating a reconstructed excitation signal for an audio signal based on received quantization indices for an excitation signal according to claim 15;

generating and spectrally shaping a reconstructed representation of the spectral envelope of the audio signal based on at least the generated reconstructed signal and received quantized representation of a spectral envelope of the audio signal to provide a synthesized audio signal;

scaling the synthesized audio signal based on received quantization indices for a gain to provide a decoded audio signal.

21. The decoding method according to claim 20, wherein:

the method operates in the time domain;

generating and spectrally shaping the reconstructed representation of the spectral envelope is based on the reconstructed excitation signal and received quantized auto regression coefficients as the representation of the spectral envelope; and scaling the synthesized audio signal is based on received quantization indices for a gain to provide the decoded audio signal.

22. The decoding method according to claim 20, wherein:

the method operates in the frequency domain;

generating and spectrally shaping the reconstructed representation of the spectral envelope is based on the generated reconstructed excitation signal; and scaling the synthesized audio signal based on received quantization indices for band gains to provide the decoded audio signal.

23. A de-quantizer for reconstructing excitation signals in a communication system, comprising one or more processors configured for:

entropy decoding a received quantized excitation signal, wherein:

the received quantized excitation signal is quantized with respect to a plurality of amplitude levels, the length of codewords of the received quantized excitation signal are based on probabilities for each of the plurality of amplitude levels occurring, and a shorter codeword length corresponds with a higher probability of an amplitude level occurring;

SQ decoding the entropy decoded excitation signal to provide a reconstructed excitation signal, and inversely re-shuffling elements of the reconstructed excitation signal.

24. The de-quantizer according to claim 23, wherein the one or more processors are configured to inversely re-shuffling elements of the reconstructed excitation signal when the elements of the reconstructed excitation signal have been previously re-shuffled in an encoder.

25. A base station terminal comprising a de-quantizer according to claim 23.

* * * * *